US005722882A

United States Patent [19]

Kashiwagi et al.

[11] Patent Number: 5,722,882

[45] Date of Patent: Mar. 3, 1998

[54] AUTOMATIC COIN DISCHARGE APPARATUS

[75] Inventors: Kyouichi Kashiwagi, Susono; Masakazu Tanaka; Hironobu Makino, both of Shizuoka-ken, all of Japan

[73] Assignee: Kabushiki Kaisha TEC, Shizuoka, Japan

[21] Appl. No.: 534,795

[22] Filed: Sep. 27, 1995

[30] Foreign Application Priority Data

Oct. 28, 1994 [JP] Japan ..... 6-265751

[51] Int. Cl.[6] ..... G07D 3/02; G07D 3/16

[52] U.S. Cl. ..... 453/11; 453/17; 453/32; 453/40

[58] Field of Search ..... 453/3, 4, 7, 11, 453/17, 20, 31, 32, 40, 49, 57, 61, 56

[56] References Cited

U.S. PATENT DOCUMENTS

| | | | |
|---|---|---|---|
| 4,883,158 | 11/1989 | Kobayashi et al. | 453/17 X |
| 4,949,532 | 8/1990 | Fujimagari et al. | 453/56 |
| 5,011,457 | 4/1991 | Takatani et al. | 453/61 |
| 5,230,653 | 7/1993 | Shinozaki et al. | 453/4 |
| 5,355,988 | 10/1994 | Shirasawa | 194/217 |
| 5,366,407 | 11/1994 | Sentoku | 453/3 |

FOREIGN PATENT DOCUMENTS

| | | | |
|---|---|---|---|
| 0211512 A2 | 2/1987 | European Pat. Off. . | |
| 0432996 A1 | 6/1991 | European Pat. Off. . | |
| 0481699 A2 | 4/1992 | European Pat. Off. . | |
| 2705495 | 5/1978 | Germany | 453/57 |
| 50-108994 | 8/1975 | Japan . | |
| 56-20854 | 5/1981 | Japan . | |
| 56-25710 | 6/1981 | Japan . | |
| 3-30930 | 6/1991 | Japan . | |
| 3-171396 | 7/1991 | Japan . | |
| 5-12981 | 2/1993 | Japan . | |
| WO 93/07592 | 4/1993 | WIPO . | |

*Primary Examiner*—F. J. Bartuska

*Attorney, Agent, or Firm*—Frishauf, Holtz, Goodman, Langer & Chick

[57] ABSTRACT

An automatic coin discharge apparatus includes a housing which has a coin-receiving opening and a coin discharge opening, a coin-storing unit which extends in the horizontal direction in the housing and stores a plurality of coins of the same denomination in a piled-up state in one line in the horizontal direction with side surfaces of the coins facing each other, a coin-urging member which urges the plurality of coins in the coin line in the coin-storing unit toward one end portion of the coin-storing unit in a direction along the coin line, a coin transporting unit which extends in the housing from the coin-receiving opening toward the one end portion of the coin-storing unit and transports coins received by the coin-receiving opening toward the one end portion of the coin-storing unit, a coin inserting unit which inserts coins transported toward the one end portion of the coin-storing unit by the coin transporting unit, into a position nearest to the one end portion of the coin-storing unit in the coin line in the coin-storing unit, and a coin discharge unit which selectively discharges the coin in the position nearest to the one end portion of the coin-storing unit in the coin line in the coin-storing unit, from the coin-storing unit toward the coin discharge opening of the housing.

25 Claims, 16 Drawing Sheets

110a

| DENOMINATION OF COIN | COUNTER FOR STORAGED COIN | COUNTER FOR DISCHARGED COIN | AREA FOR SETTING DISCHARGE NUMBER OF COIN |
|---|---|---|---|
| ¥ 1 | | | |
| ¥ 5 | | | |
| ¥ 10 | | | |
| ¥ 50 | | | |
| ¥ 100 | | | |
| ¥ 500 | | | |

110b

AREA FOR SETTING COIN-DISCHARGING FLAG

110d

TIMER COUNTER

AREA FOR SETTING COIN-STORING FLAG

110c

AREA FOR SETTING THE GREATEST NUMBER OF COINS STORABLE

110e

FIG. 15

AUTOMATIC COIN DISCHARGE APPARATUS

BACKGROUND OF THE INVENTION

1. Field of the Invention

This invention relates to an automatic coin discharge apparatus which is used for example in combination with a cash register such as an electronic cash register and the like, a vending machine and a game machine, and discharges automatically coins as the change in an amount corresponding to a coin discharge signal sent from these machines, as well as stores coins paid by customers for discharging or payment of the change.

2. Description of the Related Art

This type of conventional automatic coin discharge apparatuses are known from for example Japanese Patent Application "KOKOKU" Publication No. 56-25710 and Japanese Patent Application "KOKOKU" Publication No. 56-20854.

The automatic coin discharge apparatus disclosed in Japanese Patent Application "KOKOKU" Publication No. 56-25710 includes a plurality of vertical coin-storing tubes corresponding to various denominations of coins. Various coins received by a coin-receiving opening of the apparatus are transported toward the upper portion of the plurality of vertical coin-storing tubes, assorted by denominations at the upper portion and fallen by the gravity into the corresponding coin-storing tube for storing the corresponding denomination of coins. In each of the coin-storing tubes, a plurality of coins of one denomination are piled up in a horizontal state from the bottom of the corresponding coin-storing tubes, and from the bottoms of the plurality of coin-storing tubes, necessary denominations and necessary numbers of coins for the amount corresponding to the coin discharge signal sent from the cash register are selectively discharged, and supplied to a coin discharge opening of the apparatus.

Coins fallen into the each coin-storing tube may be sometimes in vertical posture, and these coins generally return to the horizontal posture when they collide with the top coin in the piled-up plurality of coins in the coin-storing tube. However, when a coin in the vertical posture is pressed on the top coin by the next falling coin before it is returned to the horizontal posture, the pressed coin kept rarely in the vertical posture on the top coin. The coin kept in the vertical posture in the coin-storing tube causes jamming of coins in the coin-storing tube to lead a failure of discharge of the coin from the bottom of the coin-storing tube.

Furthermore, the vertical coin-storing tubes make the height of the automatic coin discharge apparatus large and make a person who face the apparatus feel pressure from the apparatus, and requires a large setting space for the use of the apparatus with a cash register.

The automatic coin discharge apparatus disclosed in Japanese Patent Application "KOKOKU" Publication No. 56-20854 includes a rotary hopper on which many coins of various denominations received by a coin-receiving opening are accumulated like a mountain. In the bottom surface of the rotary hopper, a plurality of coin discharge holes are formed for coins of various denominations. When the rotary hopper rotates, coins are discharged outwardly in the radial direction of the rotary hopper from the accumulated coins by the centrifugal force, and necessary denominations and necessary numbers of coins for the amount corresponding to a coin discharge signal sent from the cash register are selectively discharged from the plurality of coin discharge holes, and supplied to a coin discharge opening of the apparatus.

The automatic coin discharge apparatus using the rotary hopper has a large plane shape because the rotary hopper has a large radius, and has a large height for securing a necessary space to accumulate coins like a mountain on the rotary hopper. Furthermore, since there is a limitation for the safety in the rotation speed of the rotary hopper, the discharge speed of coins is slow.

SUMMARY OF THE INVENTION

The present invention is derived from the above described circumstances, and the object of the present invention is to provide an automatic coin discharge apparatus which does not cause the failure of discharge of coins, can reduce the height thereof without reducing the same coin-storing capacity compared to that of the conventional apparatus, and has a fast coin discharge speed.

In order to achieve the above described object of the present invention, the automatic coin discharge apparatus according to the present invention comprises: a housing having a coin-receiving opening and a coin discharge opening; coin-storing means extending in substantially horizontal direction in the housing and storing a plurality of coins of the same denomination in a piled-up state in one line in the substantially horizontal direction with facing side surfaces of the coins each other; coin urging means for urging the plurality of coins in the coin line in the coin-storing means toward one end portion of the coin-storing means in a direction along the coin line; coin transporting means extending in the housing from the coin-receiving opening toward one end portion of the coin-storing means and transporting coins received by the coin-receiving opening toward the one end portion of the coin-storing means; coin-inserting means for inserting coins transported toward the one end portion of the coin-storing means by the coin transporting means, into a position nearest to the one end portion of the coin-storing means in the coin line in the coin-storing means; and coin discharge means for selectively discharging the coin in the position nearest to the one end portion of the coin-storing means in the coin line in the coin-storing means, from the coin-storing means toward the coin discharge opening of the housing.

In the automatic coin discharge apparatus according to the present invention and characterized in such a structure as described above, the height of the housing can be reduced in comparison with the conventional apparatus while having the same coin-storing capacity as that of the conventional apparatus because the coin-storing means is extended in substantially horizontal direction in the housing and a plurality of coins of the same denomination are stored in a piled-up state in one line in the substantially horizontal direction with facing side surfaces of the coins each other. And since various objects such as a cash register used in combination with the automatic coin discharge apparatus can be placed on the upper surface of the housing, an independent space for the automatic coin discharge apparatus is not required.

Coins transported from the coin-receiving opening of the housing toward one end portion of the coin-storing means by the coin transporting means are inserted securely into a position nearest to the one end portion of the coin-storing means in the coin line in the coin-storing means by the coin inserting means. And, since a plurality of coins stored in a piled-up state in one line in the substantially horizontal direction with facing side surfaces of the coins each other in the coin-storing means are selectively discharged toward the coin discharge opening of the housing from the coin in the position nearest to the one end portion of the coin-storing means in the coin line by the coin discharge means, the coin discharge speed is fast.

The automatic coin discharge apparatus according to the present invention characterized in the above described structure may further comprise a plurality of coin-storing means for storing coins of various denominations different from each other. In this case, the plurality of coin-storing means are arranged along the transporting direction of coins in the coin transporting means and extend in the same direction as to each other, the coin inserting means and the coin discharge means are provided on one end portion of each of the plurality of coin-storing means on the side of the coin transporting means, and gate means is provided in a position of the coin transporting means corresponding to one end portions of the plurality of coin-storing means. The gate means is used for assorting the coins of various denominations to supply them to the coin inserting means of one end portions of the coin-storing means corresponding to the various denominations, respectively.

By such a structure, the height of the housing can be made thin even if a plurality of coin-storing means are included.

In the automatic coin discharge apparatus according to the present invention characterized in the above described structure, the housing further has a bank note-storing drawer.

In this case, the bank note-storing drawer can be arranged between the coin-receiving opening and the coin discharge opening, and it is preferable that the coin-receiving opening is always located on the left side of the coin discharge opening.

Such an arrangement makes it easy for an operator who faces to the automatic coin discharge apparatus to throw coins by right hand to the coin-receiving opening of the automatic coin discharge apparatus and to receive coins by right hand from the coin discharge opening thereof.

Furthermore, both of the coin-receiving opening and the coin discharge opening can be arranged on the right side of the bank note-storing drawer, but even in this case, it is preferable that the coin discharge opening is arranged on the right side of the coin-receiving opening.

Such arrangement also makes it easy for the operator of the automatic coin discharge apparatus to take in and out coins to/from the automatic coin discharge apparatus.

In the automatic coin discharge apparatus according to the present invention characterized in the above described structure, assuming a portion of the housing opposite to an operator of the automatic coin discharge apparatus to be a front end portion of the housing, it is also preferable that the coin-receiving opening and the coin discharge opening are provided at the front end portion of the housing, the coin-storing means extends from the front end portion of the housing toward a rear end portion thereof, the coin transporting means extends substantially horizontally along the front end portion of the housing in a direction to cross the extending direction of the coin-storing means and transports coins in a horizontally laid down state, and the coin inserting means and the coin discharge means are provided at the front end portion of the coin-storing means.

Such structure can make the size of the plane shape of the housing small, and the coin transporting means constituted to transport coins in a horizontally laid down state can also make the height of the housing thinner. Further, since the transporting means and the storing means cross with each other, the coin transportation path is short and the possibility of the coin stack is small.

Here, when a plurality of coin-storing means are further used for coins of plural denominations, it is preferable that the plurality of coin-storing means are arranged along the transporting direction of coins in the coin transporting means and extend in the same direction as to each other, the coin inserting means and the coin discharge means are provided at the front end portion of each of the plurality of coin-storing means, and gate means is provided in each of positions of the transporting means corresponding to the front end portions of the plurality of coin-storing means in the coin transportation means, and the gate means is used for assorting the coins of various denominations to supply them to the coin inserting means of the coin-storing means corresponding to the various denominations, respectively.

By such structure, the height of the housing can be made thin even if a plurality of coin-storing means are used, and the coin-storing means can have a structure independent of the housing and the coin transporting means to make the coin-storing means being detachable to the housing.

In the automatic coin discharge apparatus according to the present invention characterized in the above described structure, it is preferable that the coin-urging means further includes a movable pushing member which is provided to be movable in a direction along the coin line of the coin-storing means and abuts against a coin located at the other end in the coin line on the opposite side to the one end portion of the coin-storing means, and a flexible elongate urging means which is extended from the movable pushing member toward the one end portion of the coin-storing means, thereafter changed its extending direction toward the other end portion of the coin-storing means on the opposite side to the one end portion of the coin-storing means, and a portion of the elongate urging means between the movable pushing member and the extending direction-changing position generates urging force toward the one end portion of the coin-storing means, and the remaining portion of the elongate urging means between the extending direction-changing position and the other end portion of the coin-storing means generates urging force toward the other end portion of the coin-storing means.

Since such a coin-urging means can set the length of the urging means along which the urging means can generate the urging force, long while the outer size of the urging means being compact, it can urge the coin line with always substantially the same strength regardless of the length of the coin line in the coin-storing means (that is, the number of coins stored in the coin-storing means).

In the automatic coin discharge apparatus according to the present invention characterized in the above described structure, the coin inserting means further has a roller coming in contact with a side surface of the coin at the position nearest to the one end portion of the coin-storing means in the coin line within the coin-storing means, the coin transporting means is located above the one end portion of the coin-storing means, and guide means for guiding a coin sent from the coin transporting means to the roller in a standing state is further provided between the coin transporting means and the roller of the coin inserting means.

Such structure is simple and compact, and operation of the structure can be controlled easily.

It is preferable that the peripheral surface of the roller of the coin inserting means is further provided with a friction-increasing member.

The friction-increasing member prevents the roller from slipping on the coin, and securely inserts the coin against the urging force of the coin-urging means, to the position nearest to the one end portion of the coin-storing means in the coin line Within the coin-storing means.

Furthermore, the width of the friction-increasing member on the peripheral surface of the roller of the coin inserting means is narrower than that of the side surface of the coin, and the frictional-increasing member may only contact the central portion of the side surface of the coin in its widthwise direction.

In this case, it is preferable that the coin discharge means further includes a roller common to that of the coin inserting means, and a coin discharge shutter provided at the one end portion of the coin-storing means to be opened selectively, and the coin discharge shutter forms an opening corresponding to the lower half of the peripheral edge of the coin at the position nearest to the one end portion of the coin-storing means in the coin line within the coin-storing means, in the opening position.

Thus, the coin discharge means having the roller common to that of the coin inserting means reduces the number of the structural elements of the automatic coin discharge apparatus and makes the structure of the apparatus simple, whereby the manufacturing cost of the automatic coin discharge apparatus and the outer size thereof can be reduced.

In the automatic coin discharge apparatus according to the present invention characterized in the above described structure, it is preferable that the coin inserting means further includes coin inserting space-producing means for pushing back the coin line in the coin-storing means toward the other end portion of the coin-storing means opposite to the one end portion thereof against the urging force of the coin-urging means to produce a space for inserting a coin from the coin transporting means to the position nearest to the one end portion of the coin-storing means in the coin line within the coin-storing means; the coin transporting means is located above the one end portion of the coin-storing means; and coin guide means for guiding a coin from the coin transporting means to the coin inserting space-producing means such that the coin reaches at the coin inserting space-producing means in a standing state, is provided between the coin transporting means and the coin inserting space-producing means of the coin inserting means.

Such a coin inserting space-producing means always guarantee easy (that is, secure) insertion of the coin from the coin transporting means to the position nearest to the one end portion of the coin-storing means in the coin line within the coin-storing means, regardless of the urging force of the coin-urging means. Namely, a large force is not necessary to insert the coin to the above described nearest position.

In this case, it is preferable that the coin inserting space-producing means of the coin inserting means further has a cam roller which contact the side surface of the coin at the position nearest to the one end portion of the coin-storing means in the coin line within the coin-storing means, and the cam roller has at least one cam projection on the peripheral surface thereof.

The cam roller has a simple and compact structure.

Furthermore, it is preferable that the coin discharge means further includes a cam roller common to that of the coin inserting means, and a coin discharge shutter provided at the one end portion of the coin-storing means to be opened selectively, and the coin discharge shutter form an opening corresponding to the lower half of the peripheral edge of the coin at the position nearest to the one end portion of the coin-storing means in the coin line within the coin-storing means, in the opening position.

The coin discharge means having the cam roller common to that of the coin inserting means reduces the number of the structural elements of the automatic coin discharge apparatus and makes the structure of the apparatus simple, whereby the manufacturing cost of the automatic coin discharge apparatus and the outer size thereof can be reduced.

And, it is preferable that the peripheral surface of the cam roller excluding the cam projection is provided with a friction-increasing member extending in the peripheral direction.

The friction-increasing member prevents the peripheral surface of the cam roller from slipping on the coin at the time that the friction-increasing member is used as the coin discharge means, and discharge of the coin from the coin line within the coin-storing means against the urging force of the coin-urging means becomes easy and secure.

Furthermore, it is preferable that the width of the friction-increasing member is narrower than that of the side surface of the coin, and the frictional-increasing member may only contact the central portion of the side surface of the coin in its widthwise direction.

Since the frictional-increasing member only contact the central portion in the widthwise direction of the side surface of the coin to apply the frictional force to the coin, the frictional force is applied to the coin only in the discharge direction thereof from the coin-storing means, whereby the force which the cam roller requires for the discharge of the coin can be reduced.

In the automatic coin discharge apparatus according to the present invention characterized in the above described structure, it is preferable that the coin transporting means is located above the one end portion of the coin-storing means and transports the coin in a horizontal state, and coin guide means for guiding the coin from the coin transporting means to the coin inserting means is further provided between the coin transporting means and the coin inserting means, the guide means changing the posture of the coin from the horizontal state to the standing state while the coin is guided from the transporting means to the inserting means.

Since the coin transporting means transports coins in a horizontal state, the height of the housing can be reduced.

And it is preferable that the coin guide means further includes kinetic energy-reducing means for absorbing the kinetic energy of the coin while it is changed from the horizontal state to the standing state and for reducing the kinetic energy of the coin when the coin arrives at the coin inserting means.

Since the coin arrives at the coin inserting means after the kinetic energy thereof is reduced by the kinetic energy-reducing means, the coin does not jump up and down when the coin arrives at the coin inserting means, so that the coin inserting means can securely perform its operation without fail.

It is preferable that the kinetic energy-reducing means further includes an elastically deformable member which is mounted to be collided with the coin while the coin is being changed from the horizontal state to the standing state so that the deformable member is elastically deformed to reduce the kinetic energy of the coin.

Such coin guide means has a simple and compact structure.

As described above, it is important that even if the coin inserting means further has the coin inserting space-producing means, the coin guide means guides the coin from the coin transporting means to the coin inserting means and at the same time changes the posture of the coin from the horizontal state to the standing state, and the coin guide means further includes kinetic energy-reducing means for absorbing the kinetic energy of the coin while it is changed from the horizontal state to the standing state and for reducing the kinetic energy of the coin when the coin arrives at the coin inserting means.

And also in this case, the kinetic energy-reducing means further includes an elastically deformable member which is mounted to be collided with the coin while being changed from the horizontal state to the standing state so that the deformable member is elastically deformed to reduce the kinetic energy of the coin.

It is preferable that the automatic coin discharge apparatus according to the present invention characterized in the above described structure further includes stored-coin number counting means for counting the number of coins currently stored in the coin-storing means by counting up every time when a coin is stored in the coin-storing means by the coin inserting means, and by counting down every time when a coin is discharged from the coin-storing means by the coin discharge means; and overflow means for discharging a predetermined number of coins from the coin-storing means by the coin discharge means when the current number of stored coins counted by the stored-coin number counting means reaches the preliminarily set greatest number.

Such structure is important because it prevents the number of stored coins in the coin-storing means from exceeding the preliminarily set greatest number during the use of the automatic coin discharge apparatus, so that the automatic coin discharge apparatus will not become unusable.

Also in this case, it is preferable that an overflow container and discharged coin-guiding means for guiding coins from the coin discharge means to the coin discharge opening of the housing are further provided in the housing, and the discharged coin-guiding means further includes overflowed coin-selecting means, the overflowed coin selecting means being operated when the overflow means is activated, and guiding the coin discharged from the coin-storing means by the coin discharge means to the overflow container.

Such structure enables to reduce the time and labor required for restarting the use of the automatic coin discharge apparatus even if the overflow means is operated during the automatic coin discharge apparatus is used, compared to the case where coins are discharged to the coin discharge opening of the housing by the overflow means and the use of the automatic coin discharge apparatus cannot be restarted unless the coins are removed.

Furthermore, the above described structure further includes full-coins sensing means for generating a full-coins sensing signal when the length of the coin line formed by a plurality of coins stored in the coin-storing means becomes longer by a predetermined distance than the length of the coin line formed by coins of the greatest number at the time of operation of the overflow means; and full-coins alarming means for giving full-coins alarm when it receives the full-coins sensing signal from the full-coins sensing means.

The full storing alarming means prevents the automatic coin discharge apparatus from being unusable when the overflow means is failed down while the automatic coin discharge apparatus is used.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 15 is a view schematically showing a structure of RAM of the control circuit of FIG. 14;

One embodiment and various modifications of the automatic coin discharge apparatus of the present invention will now be described in detail with reference to the accompanied and above described drawings.

DETAILED DESCRIPTION OF THE PREFERRED EMBODIMENTS

[One embodiment]

Figure 1:
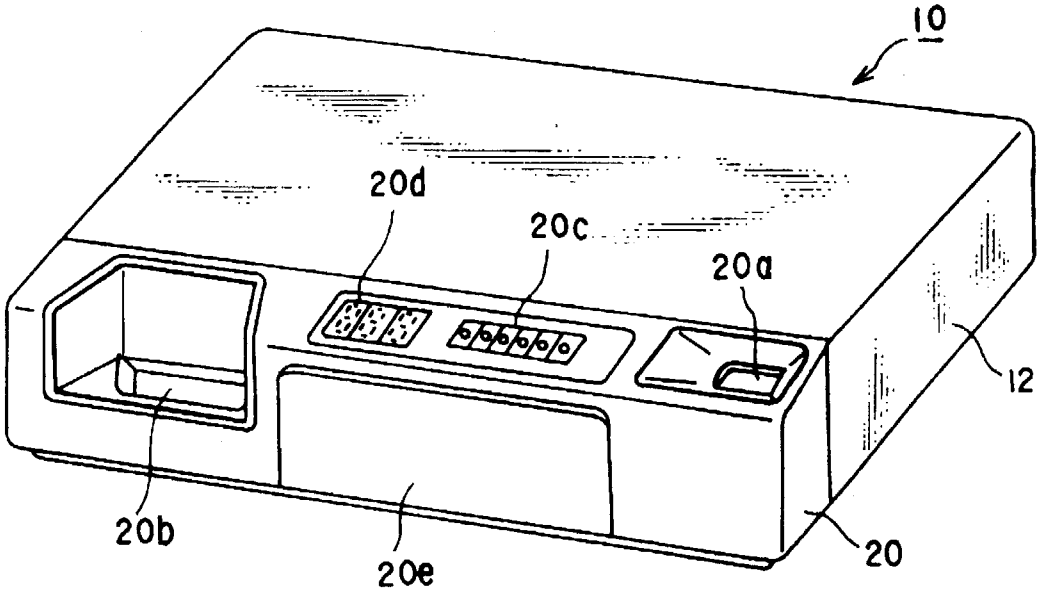
FIG. 1 is a perspective view showing an appearance of one embodiment of the automatic coin discharge apparatus of this invention.
Figure 2:
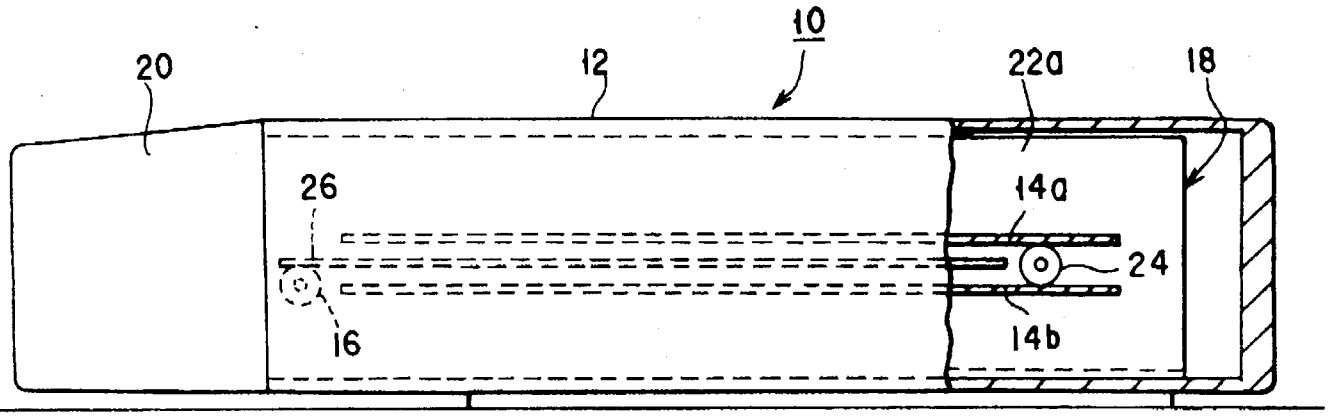
FIG. 2 is a side view showing a side surface of the one embodiment of FIG. 1 with a part of which being cut away.

FIG. 1 is a perspective view showing an appearance of one embodiment of the automatic coin discharge apparatus of this invention; FIG. 2 is a side view showing a side surface of the one embodiment of FIG. 1 with a part of which being cut away; and FIG. 3 is a plan view showing an upper surface of the one embodiment of FIG. 1 with a part of which being cut away.

As shown in FIG. 1, the automatic coin discharge apparatus 10 of one embodiment has a housing body 12 having a flat box shape. This housing body 12 opens at one end portion (to be referred as a front end portion) on its peripheral wall. On respective inner surface of both side walls located on both right and left sides of the one end portion of the housing body 12, as shown in FIGS. 2 and 3, a pair of upper and lower guide rails 14*a*, 14*b* extend horizontally from the one end portion toward the other end portion (to be referred as a rear end portion) on the peripheral wall of the housing body 12 in relatively parallel to each other. On the respective inner surface of the both side walls, a guide roller 16 is further provided in front of the upper and lower guide rails 14*a*, 14*b*.

Figure 3:
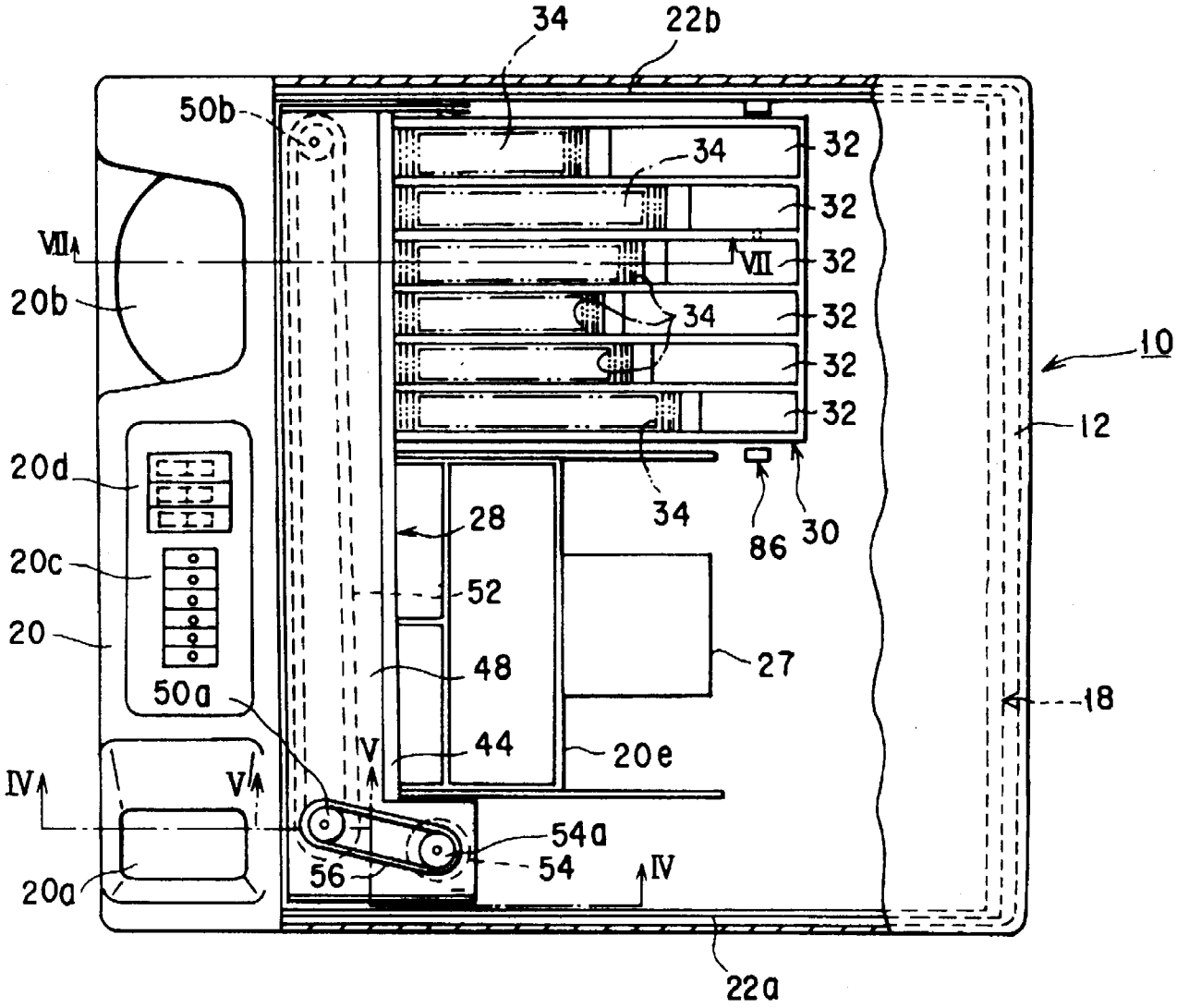
FIG. 3 is a plan view showing an upper surface of the one embodiment of FIG. 1 with a part of which being cut away.

As shown in FIGS. 2 and 3, the main portion 18 of the automatic coin discharge apparatus 10 of the one embodiment is housed in the inner space of the housing body 12, and a front cover 20 attached to the main portion 18 covers the opening at the front end portion of the housing body 12.

As shown in FIG. 2, a guide roller 24 is provided on the rear end portion of each of the right and left side plates 22*a*, 22*b* of the chassis of the main portion 18, and an intermediate guide rail 26 is further provided on each of the side plates 22*a*, 22*b* and extends horizontally and forward from a position in the vicinity and in front of the guide roller 24.

In the main portion 18, the guide roller 24 and the intermediate guide rail 26 on each of the right and left side walls 22*a*, 22*b* are inserted between a pair of the upper and lower guide rails 14*a*, 14*b* on the inner surface of the corresponding one of the both side walls of the housing body 12. And, the intermediate guide rail 26 on each of the right and left side walls 22*a*, 22*b* is placed on the guide roller 16 on the inner surface of the corresponding one of the both side walls of the housing body 12. Owing to the above described structure, the main portion 18 can freely move out from and move into the inner space of the housing body 12 through the opening at the front end portion of the housing body 12.

On an upper surface of the front cover 20 exposed from the opening at the front end portion of the housing body 12, as shown in FIG. 1, a coin receiving opening 20*a* is formed at the right end portion, and a coin discharge opening 20*b* is formed at the left end portion, and a keyboard 20*c* and a display 20*d* are further provided in the central portion.

Furthermore, in the central portion on the front surface of the front cover 20, as shown in FIG. 1, a bank note-storing drawer 20*e* is provided below the keyboard 20*c* and the display 20*d*. The bank note-storing drawer 20*e* is supported by the front cover 20 so as to freely and horizontally move out from and move into the front cover 20 in the backward and forward directions, and is selectively movable between a retracted position shown in FIG. 1 and a drawn-out position where the drawer 20*e* is drawn out from the retracted position by a drawer driving mechanism 27 housed, as shown in FIG. 3, in the inner space of the housing body 12.

When the bank note-storing drawer 20*e* is located in the retracted position, the bank note-storing drawer 20*e* is housed, as shown in FIG. 3, in the inner space of the housing body 12, and when it is located in the drawn-out position, bank notes of various denominations can be stored in an arranged state in the bank note-storing drawer 20*e*, and various kinds of bank notes already stored therein can be taken out.

A coin transporting means 28 extending in the right and left directions along the front cover 20 is provided at the front end portion of the main portion 18. At the left end of the main portion 18, a coin-storing cassette 30 is provided.

The coin-storing cassette 30 includes a plurality of coin-storing means 32 located below the left end portion of the coin transporting means 28 and arranged along the left end portion of the coin transporting means 28, and the plurality of coin-storing means 32 extend horizontally from the lower side of the left end portion of the coin transporting means 28 toward backward in parallel to each other. In each of the plural coin-storing means 32, coins of one denomination among plural denominations are stored in one line in a substantially horizontal direction with side surfaces of the coins facing each other. In FIG. 3, coin lines 34 composed of a plurality of coins stored in a plurality of coin-storing means 32 are shown in a two-dotted chain line.

Next, the coin transporting means 28 will be described in detail with reference to FIGS. 3 to 6.

Figure 4:
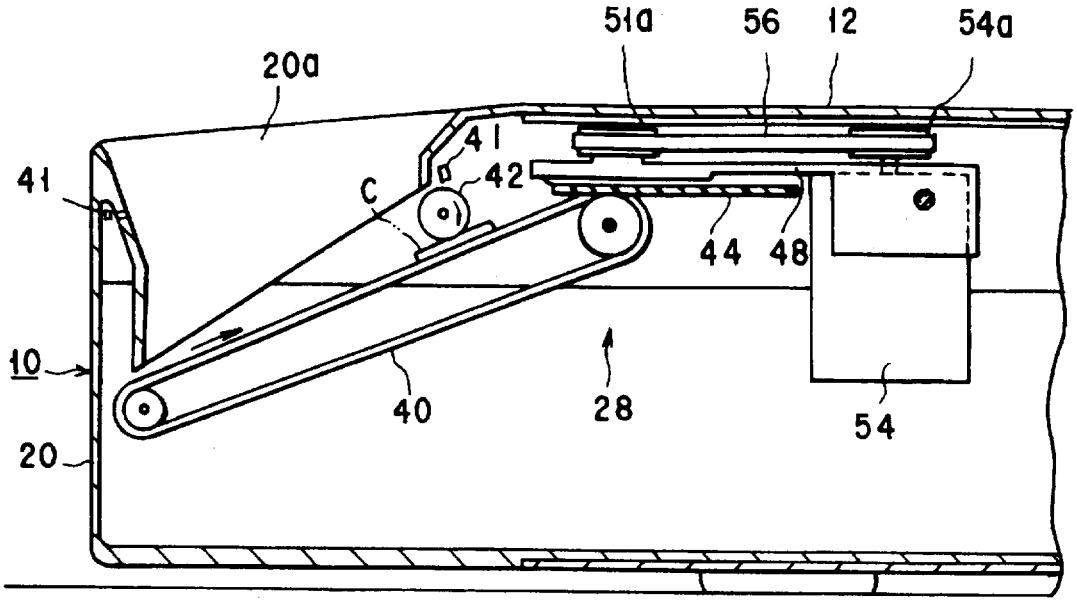
FIG. 4 is a schematic longitudinally sectional view along the line IV—IV of FIG. 3.
Figure 5:
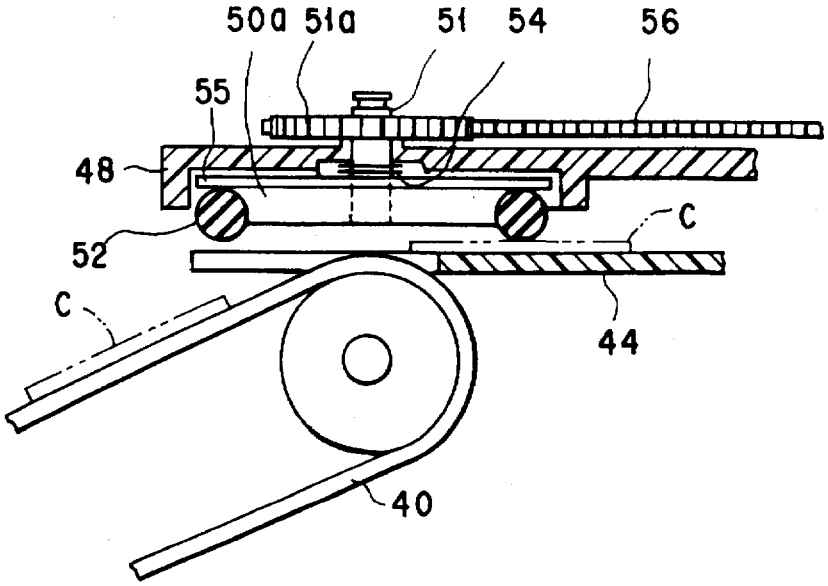
FIG. 5 is a schematic longitudinally sectional view of a part of FIG. 4 along the line V—V of FIG. 3.
Figure 6:
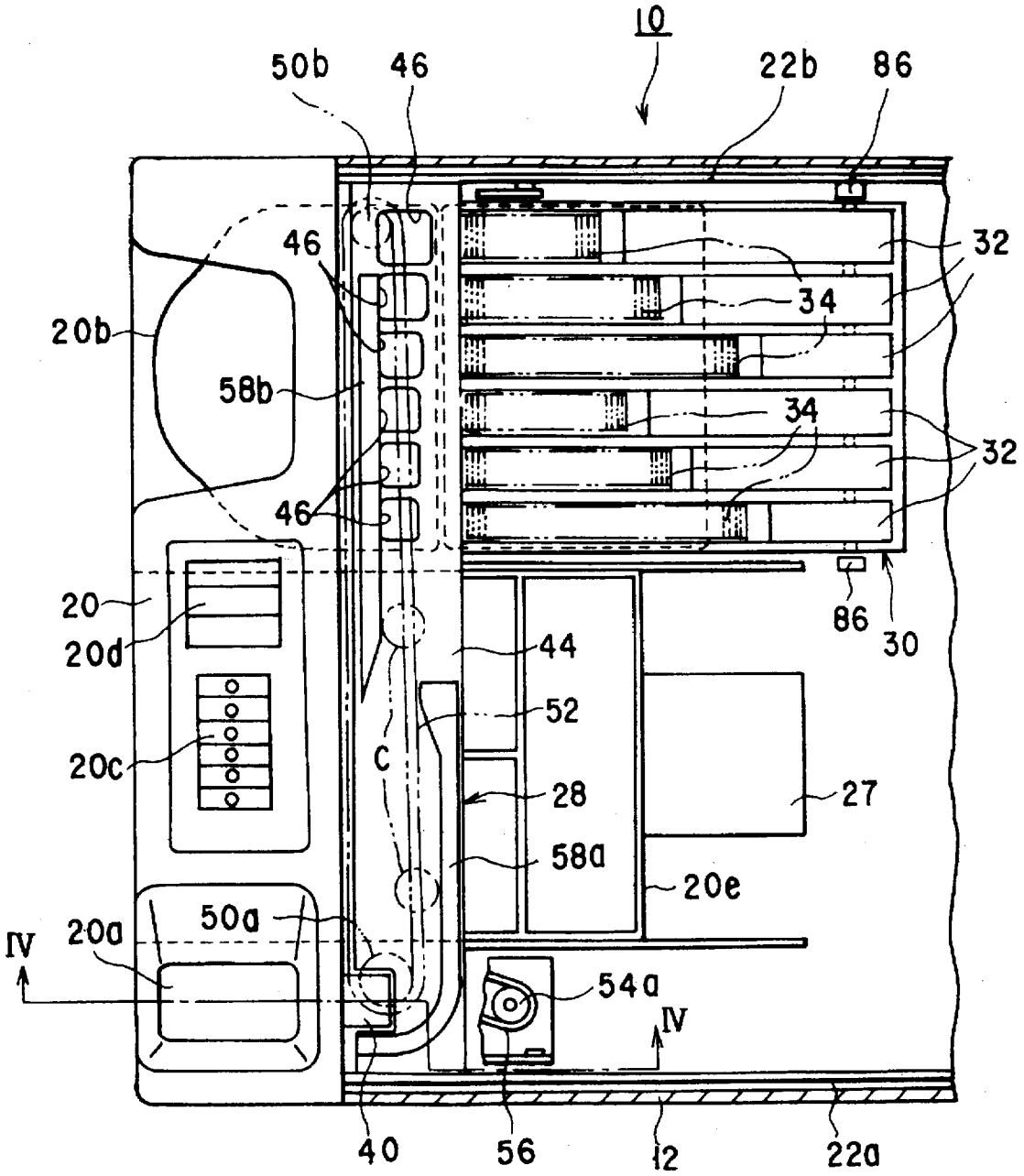
FIG. 6 is a plan view showing in detail a structure of coin transporting means of FIG. 3 by cutting the coin transporting means horizontally.

FIG. 4 is a schematic sectional view along the line IV—IV of FIG. 3; FIG. 5 is a schematic sectional view of a part of FIG. 4 along the line V—V of FIG. 3; and FIG. 6 is a plan view showing in detail a structure of the coin transporting means 28 of FIG. 3 by cutting the coin transporting means horizontally.

As shown in FIG. 4, the coin transporting means 28 includes a slanting transportation belt 40 extending from a position located below the coin receiving opening 20*a* of the front cover 20 in an intermediate direction between the backward and upward directions. A sensor 41 for received coins is provided in the coin receiving opening 20*a*, and when the received coin sensor 41 senses a coin received in the coin receiving opening 20*a*, the slanting transportation belt 40 is driven by a not-shown rotation driving means and transports the coin received in the coin receiving opening 20*a* from the position located below the coin receiving opening 20*a* in the intermediate direction between the backward and upward directions.

Furthermore, the coin transporting means 28 includes a separation roller 42 which regulates coins C on the slanting transportation belt 40 into one-layer one-line state, and a coin receiving plate 44 which receives coins from the upper end of the slanting transportation belt 40. The separation roller 42 is arranged at a position spaced upward by a predetermined distance from an upper surface of the slanting transportation belt 40 on which coins C are placed, and is rotated by a not-shown rotation driving means in an opposite direction to the moving direction of the upper surface of the slanting transportation belt 40 upon the action of the slanting transportation belt 40. The predetermined distance is larger than the thickness of one coin of any one of all denominations (stored in the plural coin-storing means 32 of the coin-storing cassette 30), but smaller than the thickness of two coins.

The coin receiving plate 44 extends horizontally from the upper end portion of the slanting transportation belt 40 to a position located above the front end portions of the plural coin-storing means 32 of the coin-storing cassette 30. At a plurality of positions of the coin receiving plate 44 corresponding to the front end portions of the plural coin-storing means 32 of the coin-storing cassette 30, a plurality of coin-assorting holes 46 corresponding to diameters of coins of plural denominations to be stored in the plural coin-storing means 32 are formed, as shown in FIG. 6. The plural coin-assorting holes 46 are arranged in order of their diameters such that the diameter of the hole 46 becomes larger as the hole located away from the slanting transportation belt 40, and each of the plural coin-assorting holes 46 allows only coins of one denomination corresponding thereto and having a slightly smaller diameter than the diameter of the corresponding one coin-assorting hole 46 to pass there through. Namely, the plural coin-assorting holes 46 form gate means which supplies the respective plural coin-storing means 32 with only coins of one denomination to be stored in the respective coin-storing means 32.

The coin transporting means 28 further includes, as shown in FIGS. 3 and 4, a coin-lift up restricting plate 48 which is arranged above the upper surface of the coin-receiving plate 44 to be spaced apart from the upper surface by a predetermined distance, and extends from a position located above the upper end portion of the slanting transportation belt 40 to a position located above the front end portions of plural coin-storing means 32 of the coin-storing cassette 30 so as to be in parallel to the upper surface of the coin-receiving plate 44.

The coin transporting means 28 more further includes a pair of driving pulley 50*a* and a follower pulley 59*b* horizontally arranged between the coin receiving plate 44 and the coin-lift up restricting plate 48 at a position located above the upper end portion of the slanting transportation belt 40 and at a position located above the front end portion of the outermost one among the plural coin-storing means 32 of the coin-storing cassette 30, and a horizontal transportation belt 52 carried over the pair of driving pulley 50*a* and follower pulley 50*b*.

A central shaft 51 of the driving pulley 50*a* which is located above the upper end portion of the slanting transportation belt 40 is, as shown in FIG. 5, supported rotatably and thrustably in the vertical direction by a predetermined distance by the coin-lift up restricting plate 48, and is urged downward by a compression coin spring 54 which is wound around the central shaft 51 between the driving pulley 50*a* and the coin-lift up restricting plate 48. The horizontal transportation belt 52 has a circular cross section as best shown in FIG. 5, a clearance of a slightly smaller distance than the thickness of a coin having the thinnest thickness among the coins of various denominations is generated between the lowest end of the horizontal transportation belt 52 and the coin-lift up restricting plate 44 when the driving pulley 50*a* is located in its lower end position.

Accordingly, the coin C arriving at the upper end portion of the slanting transportation belt 40 collides with the horizontal transportation belt 52 around the driving pulley 50*a* and is pressed onto the coin-receiving plate 44 by the horizontal transportation belt 52.

The coin transporting means 28 includes a motor 54 for driving the horizontal transportation belt 52, at a rear side of the upper end portion of the slanting transportation belt 40. And, when rotation force from an output shaft of the motor 54 is transmitted to the driving pulley 50*a* by a tooth belt 56 which is carried over an output pulley 54*a* fixed to the output shaft of the motor 54 and an input pulley 51*a* fixed to an upper end portion of the central shaft 51 of the driving pulley 50*a* which projects above the coin-lift up restricting plate 48, the horizontal transportation belt 52 is rotated in the counterclockwise direction, as shown by an arrow in FIG. 3 and FIG. 6, by the driving pulley 50*a*.

Accordingly, the coin C sandwiched by the horizontal transportation belt 52 and the coin-receiving plate 44 is transported horizontally with it sliding on the coin-receiving plate 44, toward the position located above the front end portions of the plural coin-storing means 32 of the coin-storing cassette 30 by the horizontal transportation belt 52.

On the upper surface of the coin-receiving plate 44, a pair of horizontal movement-restricting guides 58*a*, 58*b* are arranged for restricting movement of the coin C in a direction horizontally crossing with the transporting direction of the coin C by the horizontal transportation belt 52. The one horizontal movement-restriction guide 58*a* at first curves along the periphery of the driving pulley 50*a* at a position spaced outwardly apart from the periphery by a predetermined distance in the radial direction of the driving pulley 50*a*, and then extends along a rearward extending portion of the horizontal transportation belt 52, the rearward extending portion being used to transport the coin C on the coin-receiving plate 44, at a position spaced rearward by a predetermined distance from the rearward extending portion up to a substantially intermediate position of the rearward extending portion in the right and left directions. The other horizontal movement-regulating guide 58*b* extends from the substantially intermediate position to a position located near to the follower pulley 50*b* along the rearward extending portion at a position spaced forward by a predetermined distance from the rearward extending portion. And, the plurality of coin-assorting holes 46 are arranged along the horizontal movement-restriction surface (that is, the rear side surface) of the other horizontal movement-regulating guide 58*b*.

Next, a structure of the plural coin-storing means 32 of the coin-storing cassette 30 will be described in detail with reference to FIGS. 7 to 13.

Figure 7:
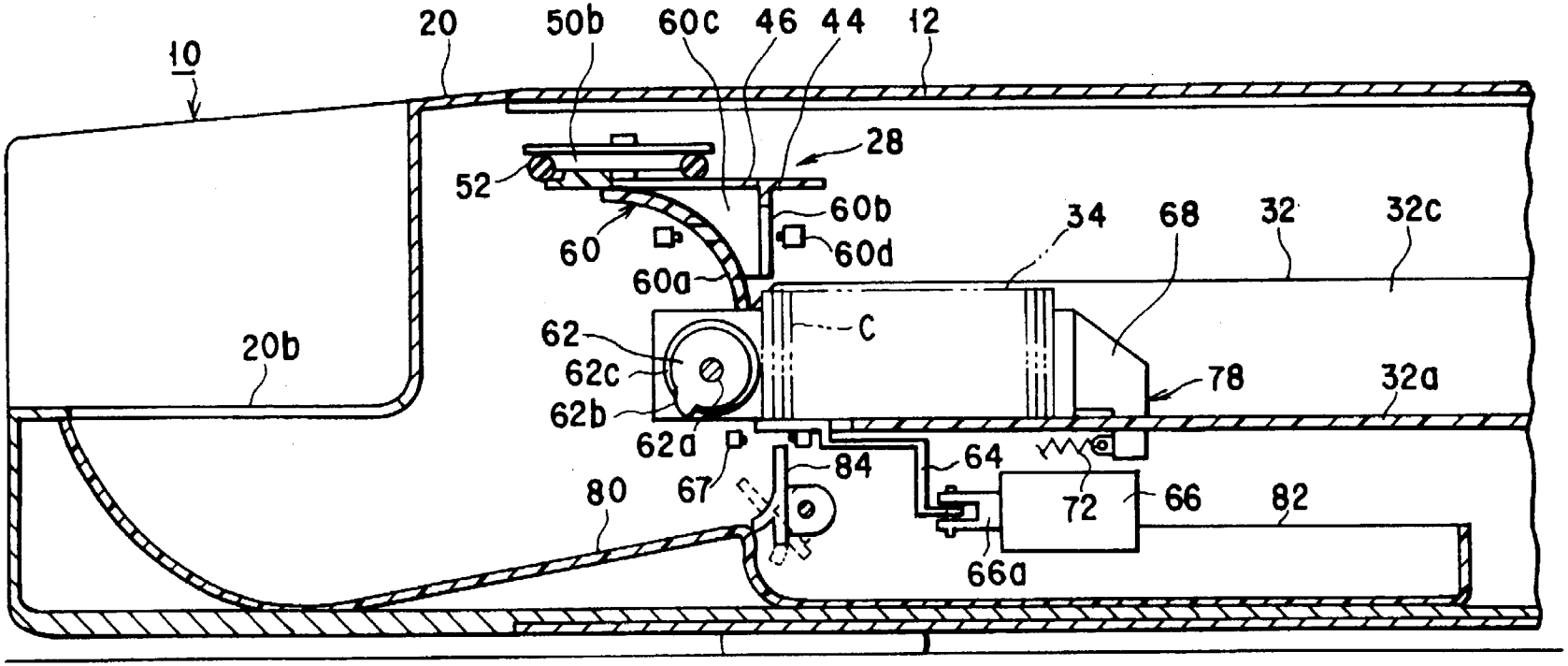
FIG. 7 is a longitudinally sectional view showing schematically a structure of one of coin-storing means along the line VII—VII of FIG. 6.
Figure 8:
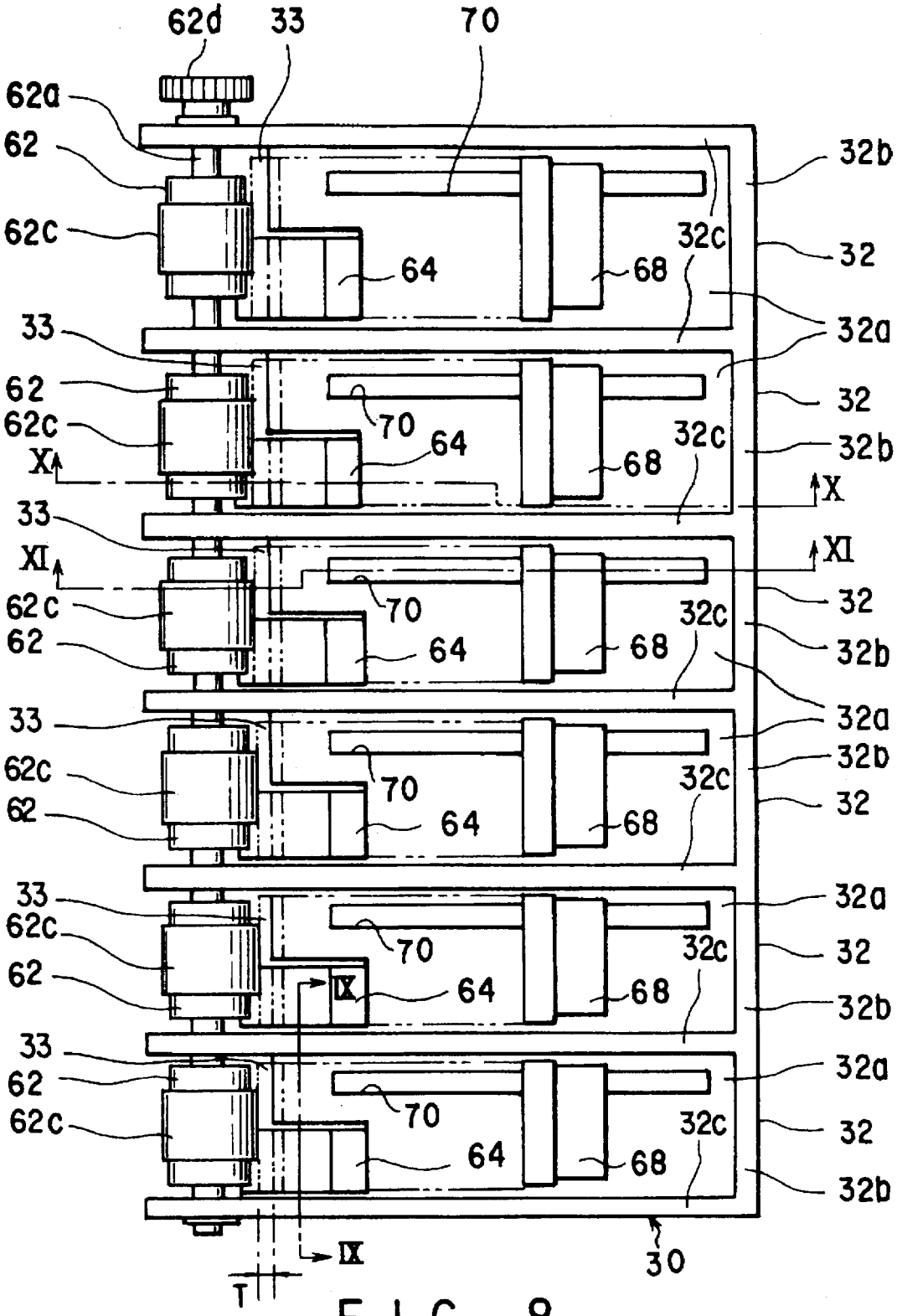
FIG. 8 is an enlarged plan view of a plurality of coin-storing means of a coin-storing cassette.
Figure 9:
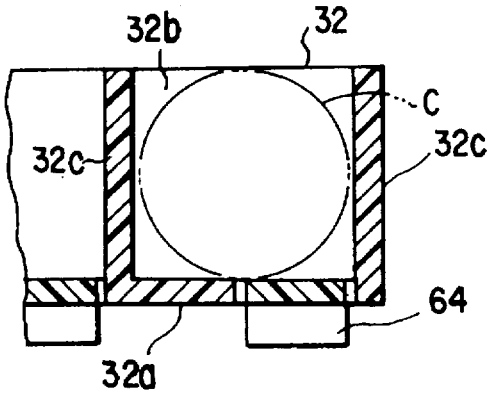
FIG. 9 is a cross sectional view along the line IX—IX of FIG. 8.
Figure 10:
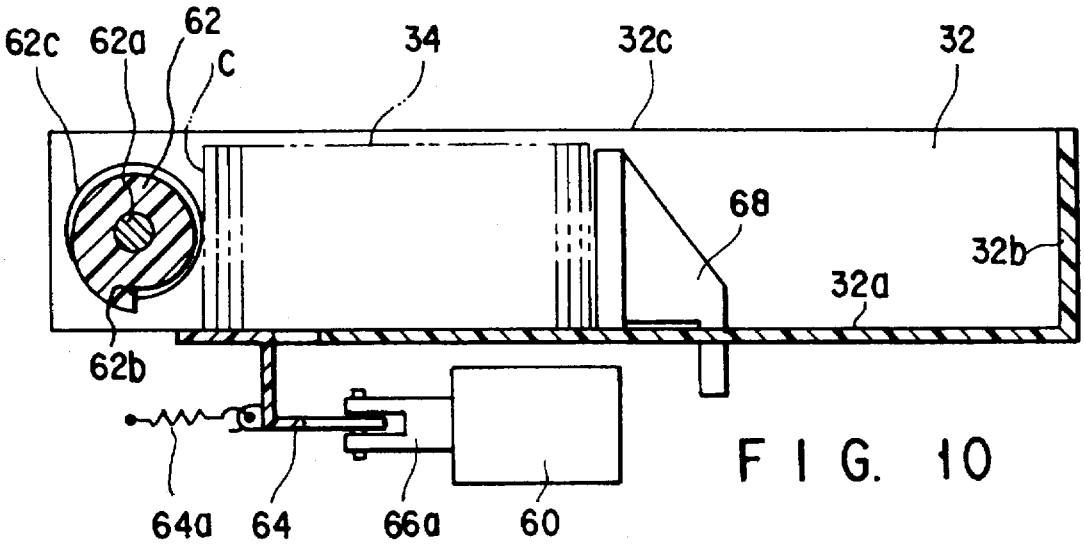
FIG. 10 is a longitudinally sectional view along the line X—X of FIG. 8.
Figure 11:
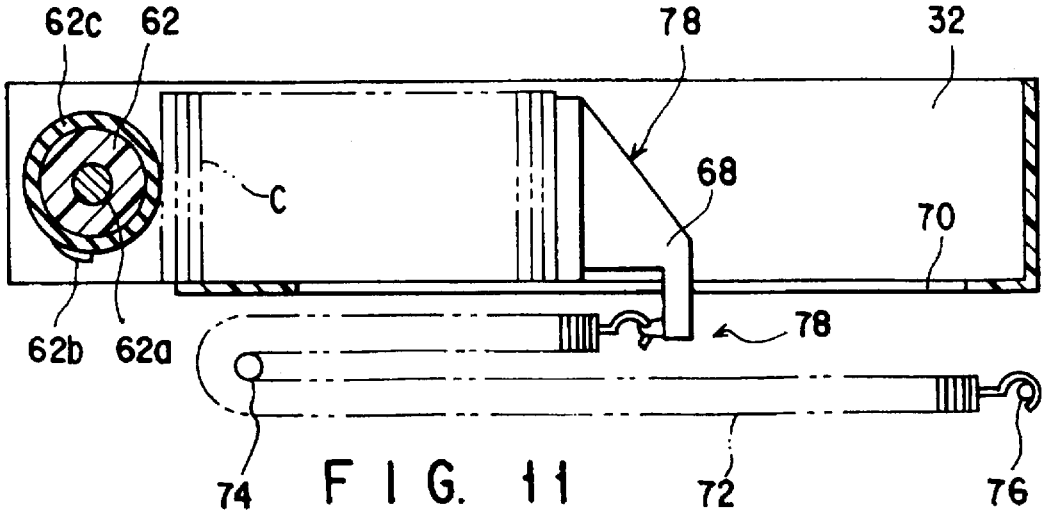
FIG. 11 is a longitudinally sectional view along the line XI—XI of FIG. 8.
Figure 12A:
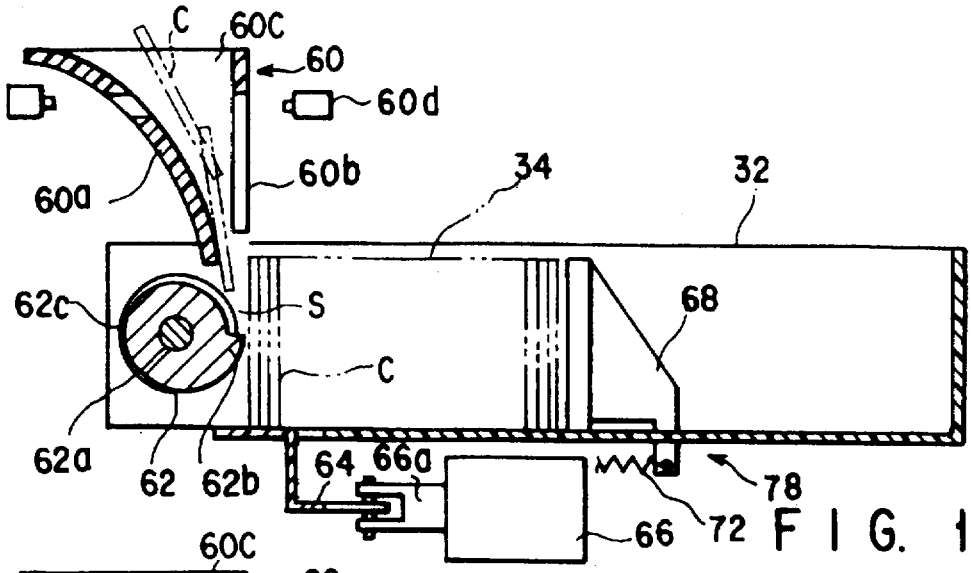
FIGS. 12A and 12B are longitudinally sectional views partially enlarged of FIG. 7 and showing how a coin from the coin transporting means is inserted into the corresponding coin-storing means by coin inserting means.
Figure 12B:
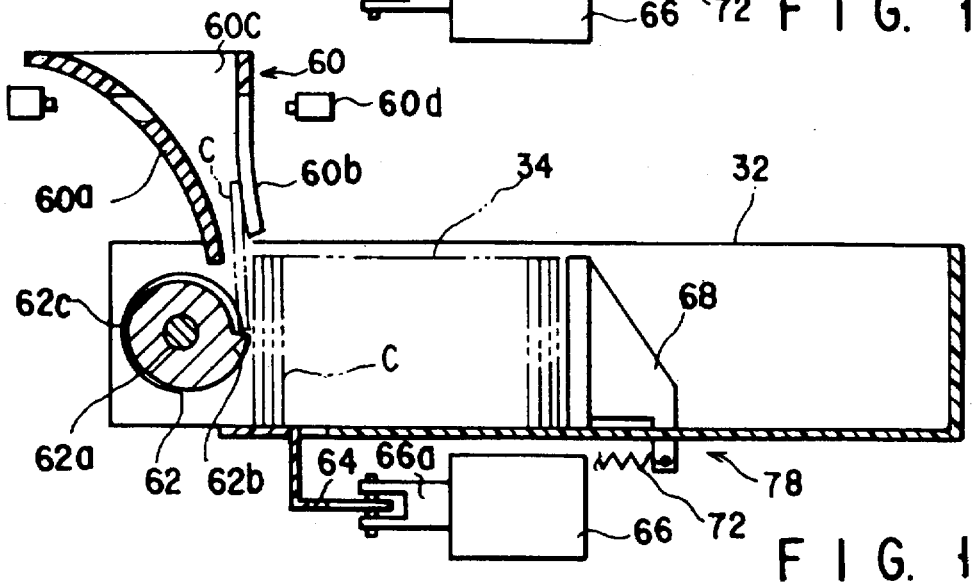
Figure 13:
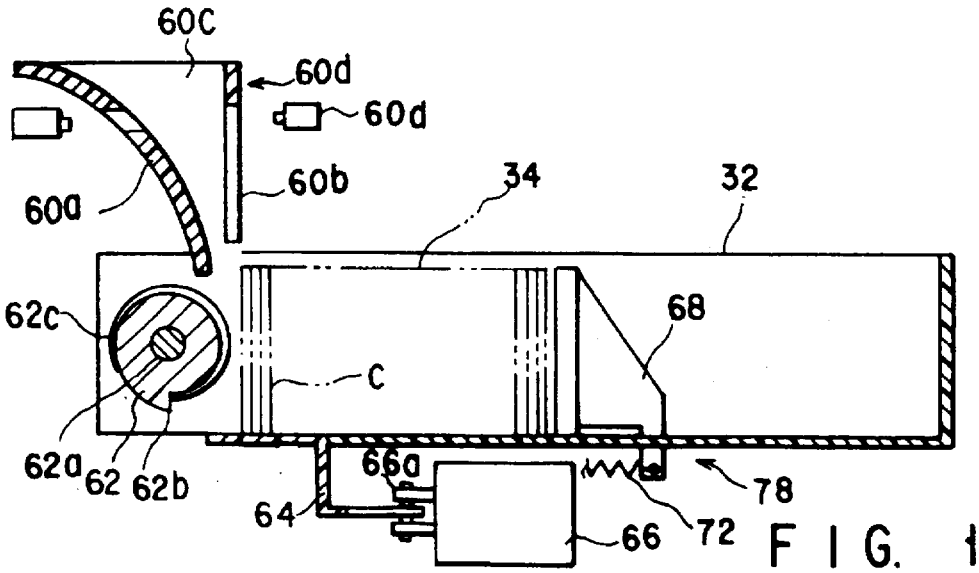
FIG. 13 is a longitudinally sectional views partially enlarged of FIG. 7 and showing how a coin is discharged from the coin-storing means by coin discharge means.

FIG. 7 is a longitudinally sectional view showing schematically a structure of one of the coin-storing means 32 along the line VII—VII of FIG. 6; FIG. 8 is an enlarged plan view of a plurality of coin-storing means 32 of the coin-storing cassette 30; FIG. 9 is a cross sectional view along the line IX—IX of FIG. 8; FIG. 10 is a longitudinally sectional view along the line X—X of FIG. 8; FIG. 11 is a longitudinally sectional view along the line XI—XI of FIG. 8; FIGS. 12A and 12B are longitudinally sectional views partially enlarged of FIG. 7 and showing how a coin C from the coin transporting means 28 is inserted into the corresponding coin-storing means 32 by coin inserting means; and FIG. 13 is a longitudinally sectional views partially enlarged of FIG. 7 and showing how a coin C is discharged from the coin-storing means 32 by coin discharge means.

Between respective plural coin-assorting holes 46 and respective front end portions of the plural coin-storing means 32 located below these holes 46, as shown in FIG. 7, guide means 60 is provided. The guide means 60 guides coins C supplied in a horizontal state to the respective coin-assorting holes 46 by the horizontal transportation belt 52 of the coin transporting means 28, to the front end portion of the respective coin-storing means 32, while changing the coin from the horizontal state to the vertical state (standing state).

Each of the guide means 60 includes a curved front wall 60a extending from a front edge of the corresponding coin-assorting hole 46 to a position close to an upper end of the front end portion of the corresponding coin-storing means 32 while changing gradually the extending direction from being in substantially horizontal to being in substantially vertical, a vertical rear wall 60b extending substantially vertically from a rear edge of the corresponding coin-assorting hole 46 and a position close to the upper end of the front end portion of the corresponding coin-storing means 32, and both side walls 60c connecting both right and left ends of the front wall 60a and both right and left ends of the rear wall 60b. A distance between inner surfaces of the both side walls 60c facing to each other is slightly larger than the diameter of the coin of a denomination passing through the coin-assorting hole 46 corresponding to the guide means 60, and a distance between a lower end of the front wall 60a and a lower end of the rear wall 60b is slightly larger than the corresponding thickness of the coin of a denomination passing through the coin-assorting hole 46. Most part of the rear wall 60b is so constituted as to be elastically deformable in the back and forth directions. When the lower end portion of the peripheral surface of the coin collides with the most part of the rear wall 60b while the coin passed through the corresponding coin-assorting hole 46 is changing from the horizontal state to the vertical state, the most part is elastically deformed so that it absorb the kinetic energy of the falling coin. The most part of the rear wall 60b as described above constitutes kinetic energy-reducing means for reducing the kinetic energy of the falling coin when the coin reaches the upper end of the front end portion of the corresponding coin-storing means 32.

Furthermore, each of the guide means 60 includes a sensor 60d which senses the coin assorted and fallen into the guide means 60 from the coin-assorting hole 46 corresponding to the assorted-coin sensor 60d.

Each of the plural coin-storing means 32 of the coin-storing cassette 30 includes, as shown in FIGS. 7, 8 and 9, a substantially horizontal flat bottom plate 32a, a back plate 32b standing upward from a rear end of the bottom plate 32a, and a pair of side plates 32c extending in parallel to each other from right and left both ends of the back plate 32b toward the front end of the bottom plate 32a.

A coin discharge opening 33 for discharging coins stored in the coin-storing means 32 is formed at a front end portion of the bottom plate 32a. The width of the coin discharge opening 33 in the right and left directions is slightly larger than the diameter of the coin of the denomination stored in the corresponding coin-storing means 32.

At the front end portion of the pair of side plates 32c, a cam roller 62 common to the coin inserting means and the coin discharge means is rotatably supported through a rotational center shaft 62a coaxially fixed to the cam roller 62 and extending horizontally in the right and left directions. The cam roller 62 is formed of a thermoplastic material such as polyacetal and the like, and includes a cam projection 62b. A friction-increasing member 62c formed of an elastic material such as urethane rubber is attached to the peripheral surface of the cam roller 62 only on the central region in the width direction of the cam roller 62 except for the cam projection 62b, to extent along the peripheral direction of the peripheral surface.

A height of the cam projection 62b from the outer peripheral surface of the friction-increasing member 62c is set to be slightly larger than the thickness of one coin stored in the coin-storing means 32 corresponding to the cam roller 62. And, the distance T between the rear edge of the coin discharge opening 33 at the front end portion of the bottom plate 32a and a position on the outer peripheral surface of the friction-increasing member 62c located nearest to the rear edge of the coin discharge opening 33 is, as shown in FIG. 8, set to be slightly larger than the thickness of one coin stored in the coin-storing means 32, but slightly smaller than the thickness of two coins. That is, the coin discharge opening 33 cooperates with the outer peripheral surface of the friction-increasing member 62c to provide a coin discharge passage having a slightly larger size than that of a cross section of a center portion of one coin stored in the coin-storing means 32.

The coin discharge means further includes a coin discharge shutter 64 movable between a closed position at which the shutter 64 projects into the coin discharge opening 33 from the front end portion of the bottom plate 32a and covers at least a central portion of the coin discharge opening 33 in the right and left directions, and an open position at which the shutter 64 moves backward from the coin discharge opening 33 to open the coin discharge opening 33. The coin discharge shutter 64 is urged toward the closed position by a tension coin spring 64a (urging means) interposed between itself and the chassis of the main portion 18, as shown in FIG. 10. In FIGS. 7 and 8, the coin discharge shutter 64 is located at the closed position.

The coin discharge shutter 64 is connected with a plunger 66a of a plunger/solenoid assembly 66 under the bottom plate 32a. When the plunger 66a is operated by applying electric current to the plunger/solenoid assembly 66, the coin discharge shutter 64 is moved backward from the closed position shown in FIG. 7 and FIG. 8, against the urging force of the tension coin spring 64a, and located at the open position where the coin discharge shutter 64 opens the coin discharge opening 33.

Right under the coin discharge opening 33, a sensor 67 for sensing the coin discharged from the coin discharge opening 33 is arranged.

A movable pushing member 68 is further provided on the bottom plate 32a so as to be freely movable in the back and forth directions on the upper surface of the bottom plate 32a. The movable pushing member 68 projects downward from the lower surface of the bottom plate 32a through a slot 70 formed in the bottom plate 32a and extending in the back and forth directions, and is connected with an urging means 72 for urging the movable pushing member 68 forward under the bottom plate 32a.

The urging means 72 is, as shown in FIG. 11, structured by a long and narrow and flexible tension coin spring. The tension coin spring extends forward from a lower end portion of the movable pushing member 68 under the bottom plate 32a, wound on the roller 74 supported on the chassis of the main portion 18 in the vicinity of the front end portion of the bottom plate 32a to change its extending direction, extends backward, and fixed at its backward extending end to the fixed pin 76 fixed on the chassis of the main portion 18. The urging means 72 generates urging force directed forward between the lower end portion of the movable pushing member 68 and the extending direction-changing position at the roller 74, and generates urging force directed backward between the extending direction-changing position and the fixed pin 76 at the backward extending end of the urging means 72. The urging force directed backward is changed its direction in which the urging force is applied, at the extending direction-changing position, so that applies its urging force to the lower end portion of the movable pushing member 68 to move the movable pushing member 68 forward.

And, the combination of the movable pushing member 68 and the urging member 72 functions as coin-urging means 78 for urging the coin line 34 in the corresponding coin-storing means 22 toward the front end portion of the coin-storing means 32 by abutting the movable pushing member 68 against the side surface of the coin located at the last of the coin line 34.

When the coin-receiving sensor 41 (see FIG. 4) senses a coin received in the coin-receiving opening 20*a* of the housing 12, a rotation force is transmitted to the cam roller 62 from a not-shown motor set on the chassis of the main portion 18 via an input pulley 62*d* fixed to the outer end portion of the rotational center shaft 62*a*, and the cam roller 62 is rotated in the clockwise direction in FIG. 7 until the cam projection 62*b* is directed toward the movable pushing member 68. As a result of this, if there is no coin C in the coin-storing means 32, the cam projection 62*b* moves the movable pushing member 68 backward against the urging force of the urging member 72 by the height of the cam projection 62*b*, and if there is at least one coin C in the coin-storing means 32, the cam projection 62*b* moves the movable pushing member 68 backward against the urging force of the urging member 72 by the height of the cam projection 62*b* via the coin C adjacent to the cam projection 62*b*.

And, as shown in FIG. 12A, a coin inserting space S for inserting a new coin C in a vertical state is generated in the coin-storing means 32 between a base end of the cam projection 62*b* on the outer peripheral surface of the cam roller 62 and the movable pushing member 68 or the coin C pushed by the cam projection 62*b* as described above. At this time, the cam roller 62 functions as coin inserting space-producing means.

The coin C fallen into the guide means 60 located above the front end portion of the coin-storing means 32 is changed from the horizontal state to the vertical state during a predetermined period of time have passed since the assorted coin sensor 60*c* sensed the coin C fallen into the guide means 60, and its kinetic energy is absorbed by the rear wall 60*b* of the guide means 60 as described above, and finally, as shown in FIG. 12B, is inserted into the coin inserting space S of FIG. 12A in a vertical state. When the coin C the kinetic energy of which is reduced collides with the cam projection 62*b* of the cam roller 62 in the coin inserting space S, jump up of the coin C can be restricted to the minimum.

After a predetermined period of time have passed since the assorted coin sensor 60*c* sensed the coin C fallen into the guide means 60, the cam roller 62 rotates at one time in the clockwise direction from the position shown in FIG. 12B, so that the coin C within the coin inserting space S is inserted in front of the movable pushing member 68 or in front of the coin C nearest to the cam roller 62 within the coin-storing member 32, by the friction-increasing member 62C on the outer peripheral surface of the cam roller 62 to form a coin line 34. The coin C stored in the coin-storing means 32 is held in a vertical state between the cam roller 62 and the movable pushing member 68. And, when a plurality of coins C are stored in the coin-storing means 32, these coins C are arranged in one line in the horizontal direction with their side surfaces being in contact with each other.

When one coin C is discharged from the coin-storing means 32, at first, as shown in FIG. 13, the coin discharge shutter 64 is moved against the urging force of the tension coin spring 64 to the open position by the plunger/solenoid assembly 66, and the cam roller 62 is rotated about half in the clockwise direction from the coin inserting space-producing position shown in FIG. 12A and FIG. 12B while the coin discharge shutter 64 is held in the open position. The coin C which is located adjacent to the outer peripheral surface of the cam roller 62 is moved downward, as shown in FIG. 13, against the urging force by the movable pushing member 68, from the coin line 34 within the coin-storing means 32 by the friction force generated between the side surface of the coin C and the friction-increasing member 62C on the outer peripheral surface of the cam roller 62 being in contact therewith, and is discharged downward through the coin discharge opening 33. When the discharged coin sensor 67 senses that the discharge of the coin C from the coin discharge opening 33 has been completed, the rotation of the cam roller 62 is stopped and applying of electric current to the plunger/solenoid assembly 66 is stopped so that the coin discharge shutter 64 is returned to the closed position by the urging force of the urging means 64*a*, as shown in FIG. 7, FIG. 12A and FIG. 12B.

Under the coin discharge opening 33 of the coin-storing means 32, a discharged-coin guiding chute 80 as a discharged coin-guiding means extending obliquely downward and forward toward a bottom of the coin discharge opening 20*b* of the front cover 20, and an overflow container 82 extending backward opposite to the front cover 20 are arranged.

A coin-selecting gate member 84 is disposed as a coin-selecting means on a boundary between the discharged coin-guiding chute 80 and the overflow container 82. The coin-selecting gate member 84 is selectively rotated by a not-shown motor between an usual position at which the gate member 84 closes an entrance of the overflow container 82 and opens an entrance of the discharged coin-guiding chute 80, as shown in a solid line in FIG. 7, and an overflow position at which the gate member 84 opens the entrance of the overflow container 82 and closes the entrance of the discharged coin-guiding chute 80, as shown in a dotted line in FIG. 7.

Furthermore, at a rear end portion of the plural coin-storing means 32, as shown in FIG. 7, a sensor 86 for full storaged coin is arranged at a position at which the length of the coin line 34 formed by a plurality of coins C exceeds the preliminarily determined greatest number to be stored in the each plural coin-storing means 32.

Figure 14:
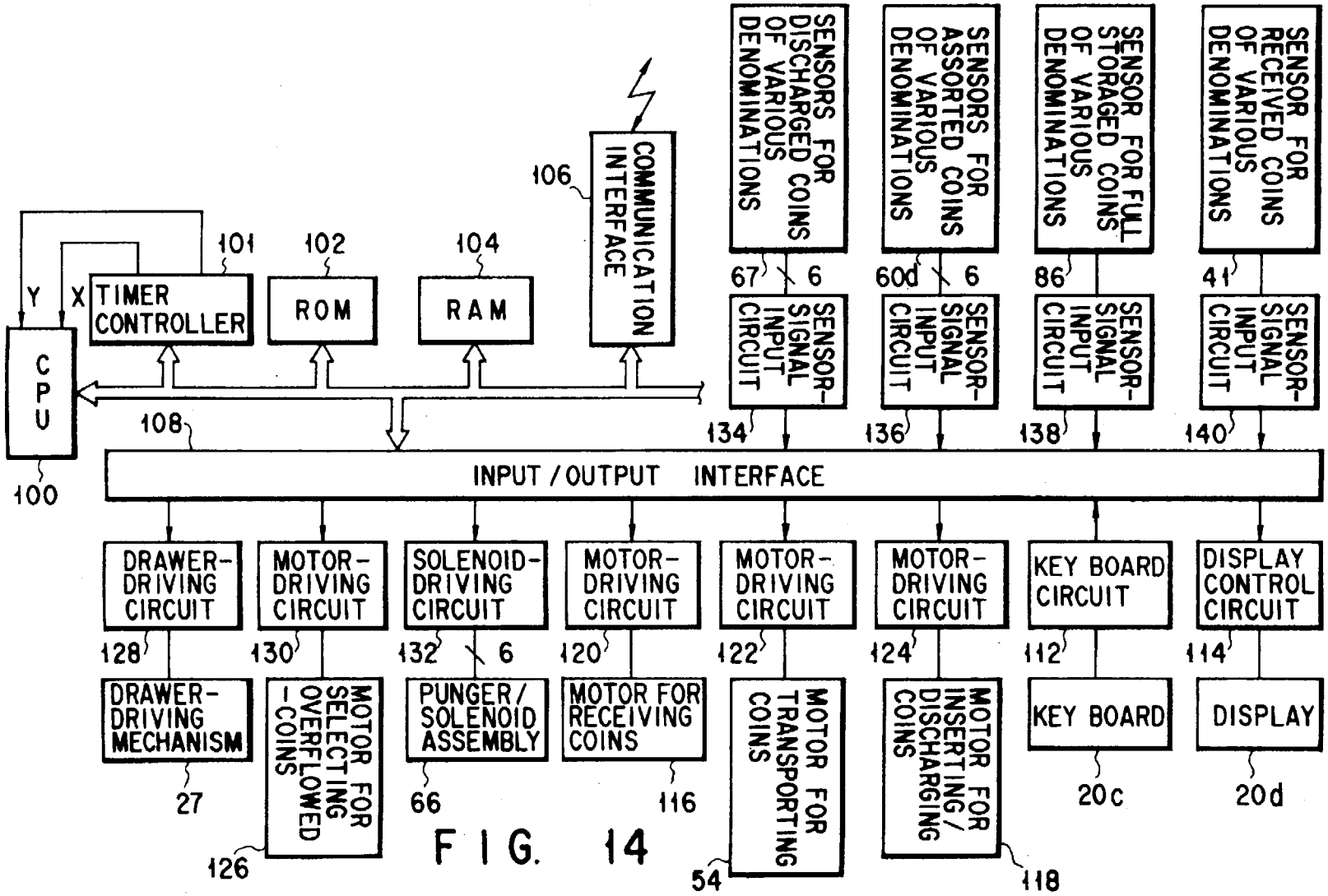
FIG. 14 is a block diagram schematically showing a structure of a control circuit of one embodiment of the automatic coin discharge apparatus of the present invention.

FIG. 14 is a block diagram schematically showing a structure of a control circuit of the one embodiment of the automatic coin discharge apparatus of the present invention as described above.

The control circuit of this embodiment includes CPU 100 as a main controller, and a timer controller 101 which generates interrupt signals X and Y periodically with a time interval preliminarily set to the CPU 100.

Furthermore, this control circuit includes ROM 102 and RAM 104 as a main memory controlled by CPU 100, and also includes a communication interface 106 being in accordance with, for example, RS 232C specification and an input/output interface 108.

And, CPU 100, the timer controller 101, ROM 102, RAM 104, the communication interface 106 and the input/output interface 108 are connected by bus lines such as address bus, data bus and the like.

In ROM 102, a read-only data such as a program to be executed by CPU 100 and the like is preliminarily stored.

Furthermore, in RAM 104, as shown in FIG. 15, a denomination table 110*a*, an area 110*b* for setting coin-discharging flag, an area 110*c* for setting coin storing flag, a timer counter 110*d*, and an area 110*d* for setting the greatest number of coins storable are provided: in the denomination table 110*a*, a stored coin counter, a discharged coin counter, and a coin discharge number area are prepared for each of the plural denominations of coins (for example, ¥500, ¥100, ¥50, ¥10, ¥5, ¥1, which are now used in Japan); in the coin-discharging flag setting area 110*b*, a coin-discharging flag is set during the coin discharge process for a change is performed; in the coin-storing flag setting area 110*d*, a coin-storing flag is set during the received coin storing process; in the timer counter 110*d*, time is counted from that a plurality of coins are received at a time in the coin-receiving opening 20*a* to that the last coin among the coins C transported in one layer and in one line on the upper surface of the coin-receiving plate 44 is stored in the corresponding coin-storing means 32; and in the greatest number of storable coins setting area 110*e*, the greatest number of coins to be stored in the coin-storing means 32 is set.

The greatest number of coins is so set as to be fewer than the number of coins which form the coin line 34, sensed by the full storage coin sensor 86 provided in the coin-storing means 32, and may be common to all denominations or may be different for every denomination.

One POS terminal or plural POS terminals is/are connected to the communication interface 106 via a cable or cables for interface, and the communication interface 106 receives a coin discharge data (data corresponding to the change paid by coins) generated by the POS terminal or POS terminals.

To the input/output interface 108, a key board circuit 112 which takes key signal from the keyboard 20*c* (see FIG. 1) on the center of the upper surface of the front cover 20, and a display control circuit 114 which controls data display in the display 20*d* (see FIG. 1) on the center of the upper surface of the front cover 20 are connected.

Furthermore, three motor driving circuits 120, 122, 124 and the other three driving circuits 128, 130, 132 are connected to the input/output interface 108. The first motor driving circuit 120 controls turn-on and turn-off of a motor 116 for receiving coins as rotation driving means of the slanting transportation belt 40 (see FIG. 4) arranged below the coin-receiving opening 20*a*, the second motor driving circuit 122 controls turn-on and turn-off of the motor 54 for transporting coins (see FIG. 3) used to drive the horizontal transportation belt 52, and the third motor driving circuit 124 controls turn-on and turn-off of a motor 118 (for inserting/discharging coins) used to drive the cam roller 62 common to the coin insertion means and the coin discharge means. Further, the first other driving circuit 128 is a drawer driving circuit which controls turn-on and turn-off of the drawer driving mechanism 27 used to open and close the bank note-storing drawer 20*e* (see FIG. 1), the second other driving circuit 130 is a motor driving circuit which controls turn-on and turn-off of a motor 126 (for selecting overflowed coins) used to drive the coin-selecting gate member 84 (see FIG. 7), and the third other driving circuit 132 is a solenoid-driving circuit which controls turn-on and turn-off of the plunger/solenoid assembly 66 for driving the coin discharge shutter 64 (see FIG. 7).

Additionally, four sensor-signal input circuits 134, 136, 138 and 140 are connected to the input/output interface 108: to the first sensor-signal input circuit 134, signal from the sensor 41 for received coins of various denominations (see FIG. 4) provided in the coin-receiving opening 20*a* is input; to the second sensor-signal input circuit 136, signal from the sensor 86 for full storage coins of various denominations (see FIG. 6) arranged in a plurality of coin-storing means 32 of the coin-storing cassette 30 is input; to the third sensor-signal input circuit 138, signals from the plural assorted coin sensors 60*c* disposed in the coin guide means 60 located above the front end portions of the plural coin-storing means 32 (in this embodiment, 6 denominations, see FIG. 15) are input; and to the fourth sensor-signal input circuit 140, signals from the plural coin discharge sensors 67 disposed right under the coin-discharge openings 33 at the front end portions of the plural coin-storing means 32 (in this embodiment, 6 denominations, see FIG. 15) are input.

Next, various control steps of CPU 100 according to programs in ROM 102 will be described with reference to FIGS. 16–19.

Figure 16:
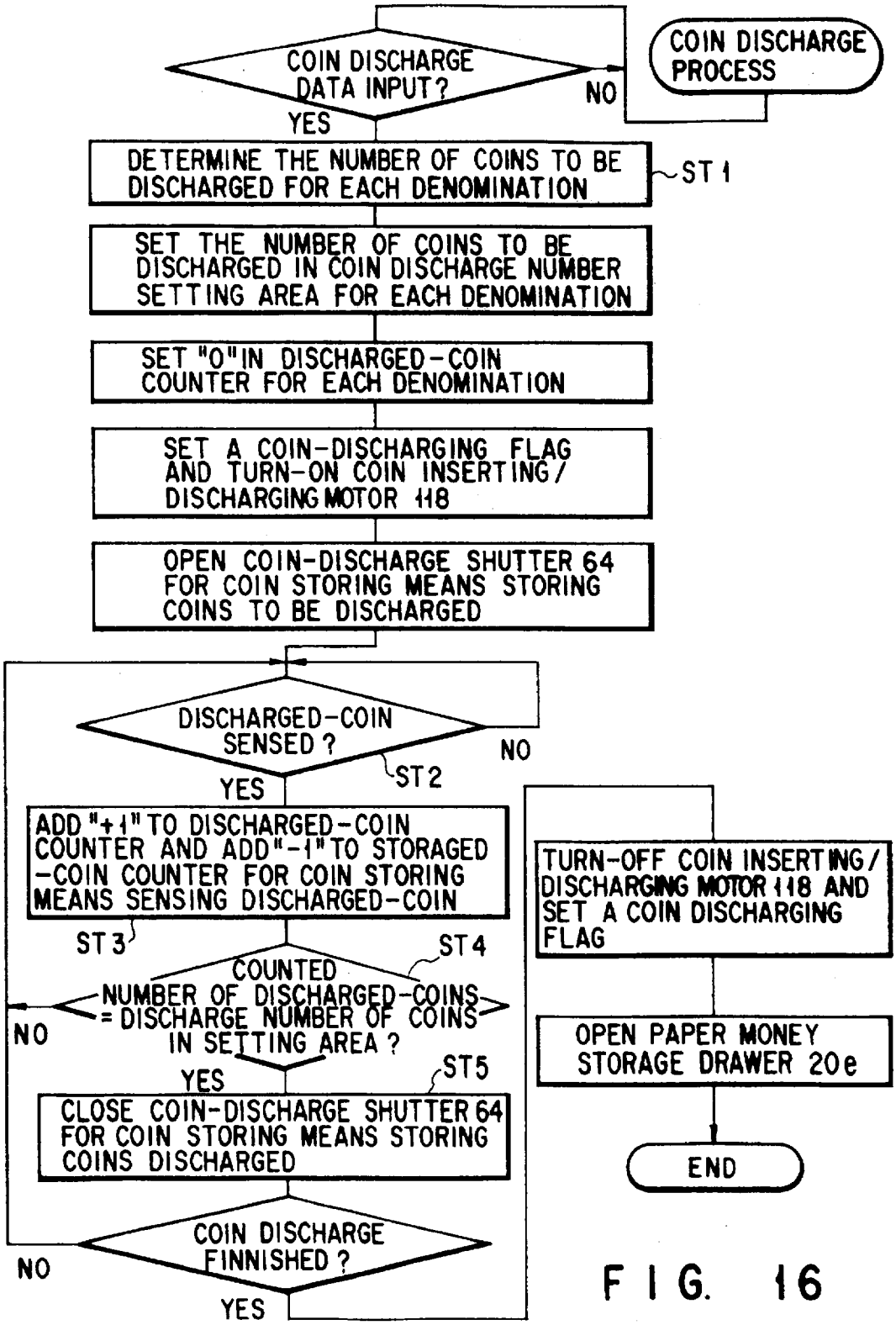
FIG. 16 is a flow chart showing control steps for a coin discharge process in the control circuit of FIG. 14.
Figure 17:
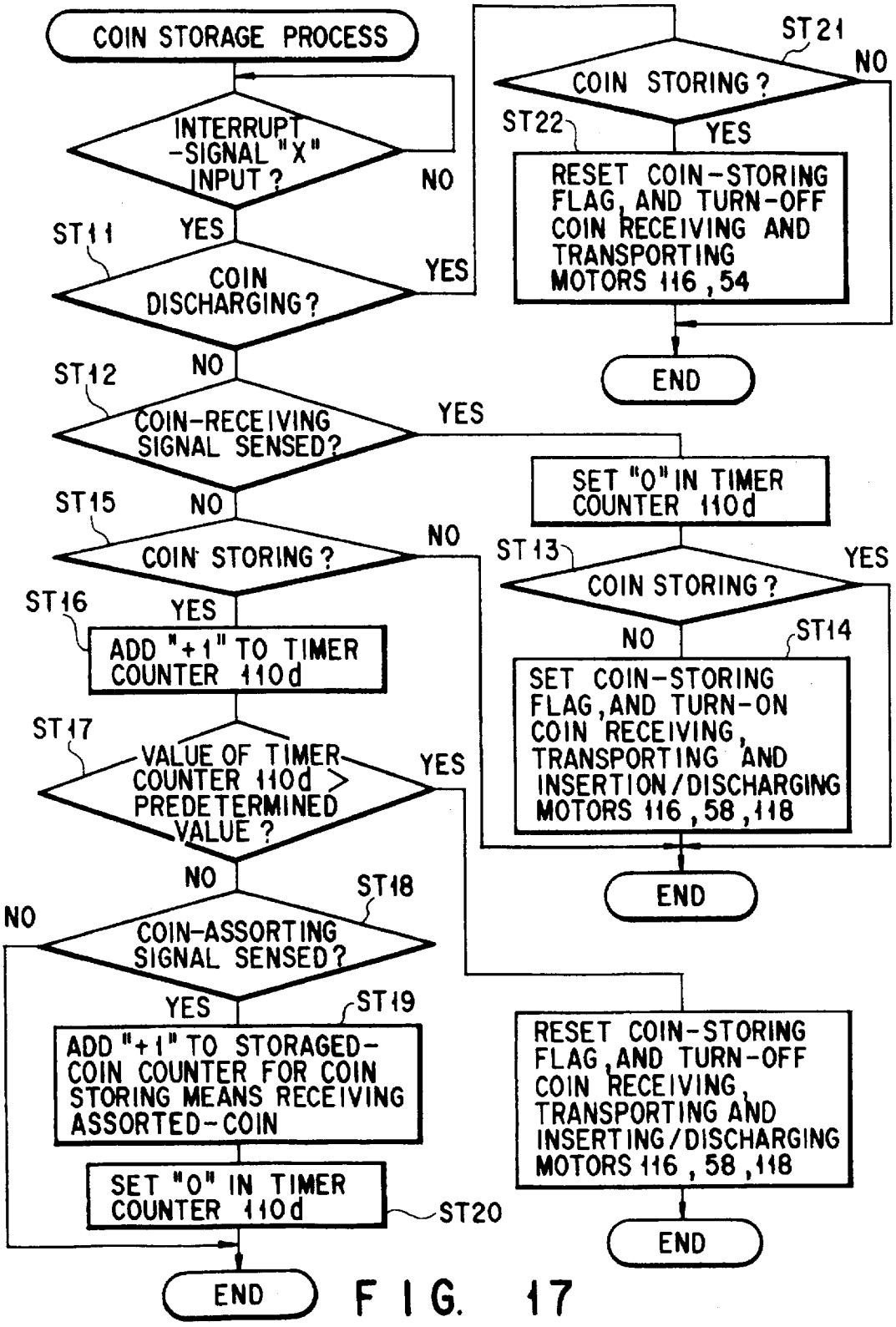
FIG. 17 is a flow chart showing control steps for a coin storage process in the control circuit of FIG. 14.
Figure 18:
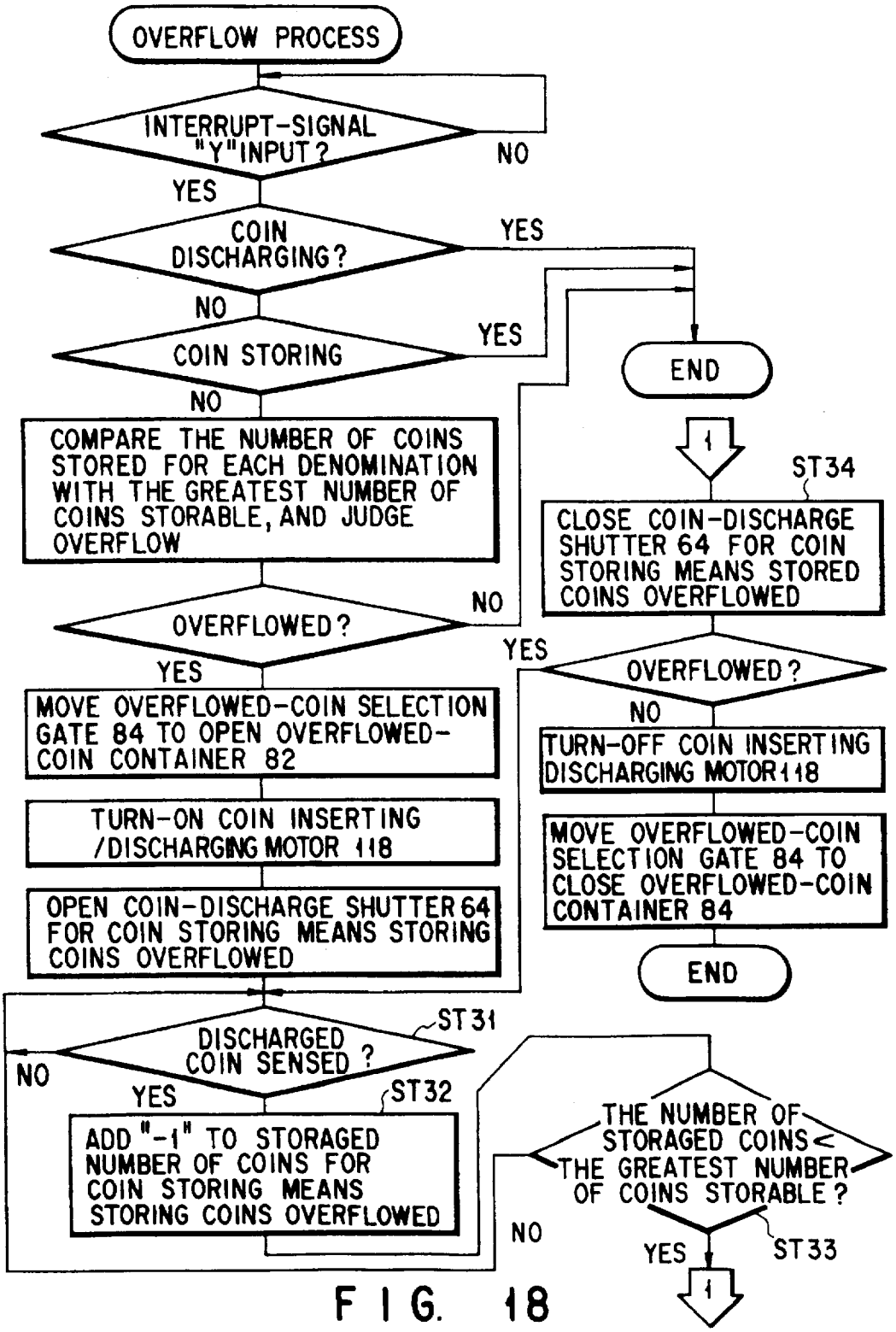
FIG. 18 is a flow chart showing control steps for an overflow process in the control circuit of FIG. 14.
Figure 19:
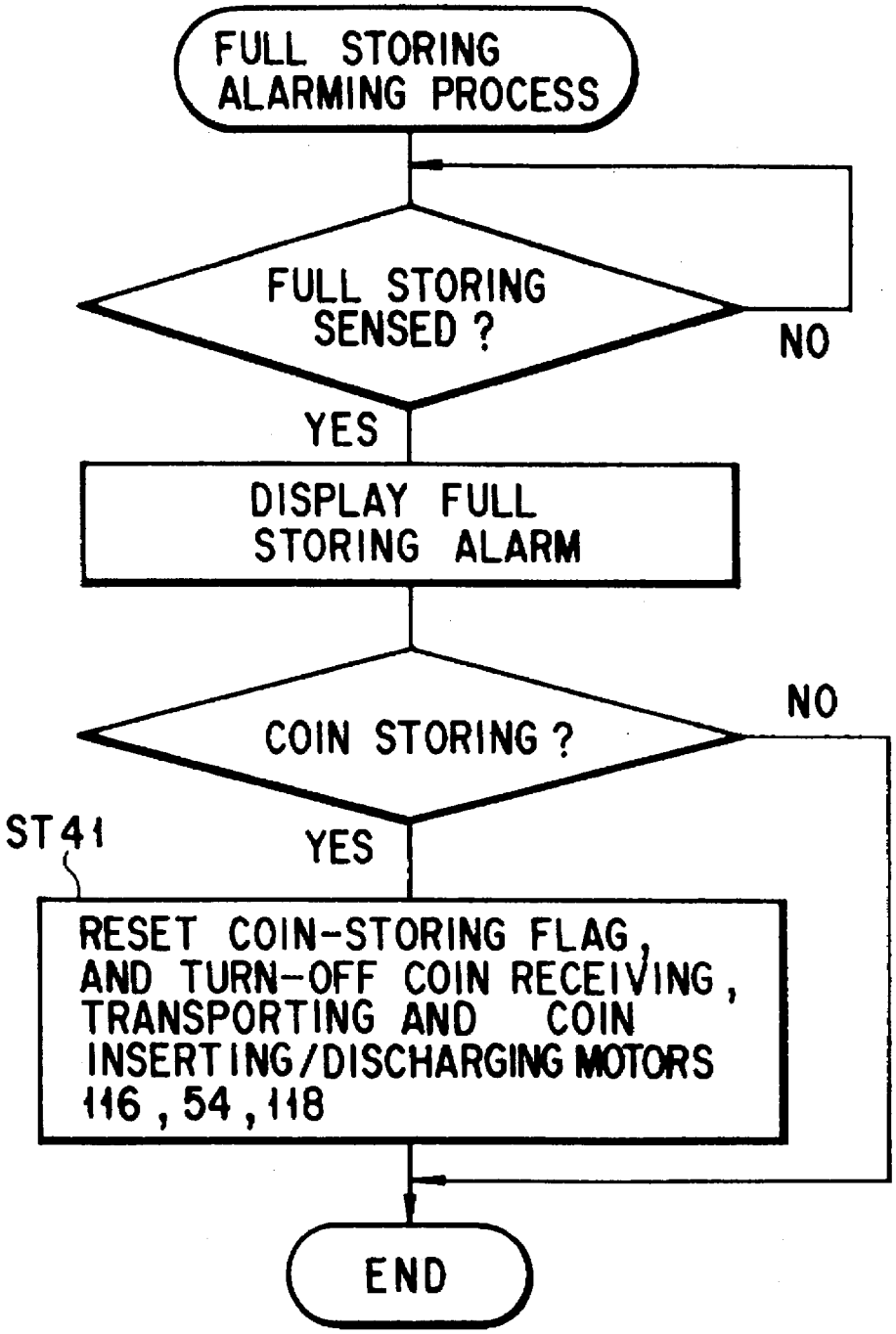
FIG. 19 is a flow chart showing control steps for a full storing alarming process in the control circuit of FIG. 14.

FIG. 16 is a flow chart showing control steps for a coin discharge process in the control circuit of FIG. 14, FIG. 17 is a flow chart showing control steps for a coin storage process in the control circuit of FIG. 14, FIG. 18 is a flow chart showing control steps for an overflow process in the control circuit of FIG. 14, and FIG. 19 is a flow chart showing control steps for a full storing alarming process in the control circuit of FIG. 14.

[Coin Discharge Process: see FIG. 16]

When CPU 100 receives coin discharge data corresponding to a change amount to be paid by coins, from one POS terminal via the communication interface 106, CPU 100 determines at ST (step) 1 the number of coins to be discharged for each denomination, so that the total number of coins to be discharged becomes minimum.

Concretely, at first it is determined that whether the coin discharge data is larger than ¥500 (the maximum denomination of coins in Japan) or not, and "1" is set as a discharge number of ¥500 only when the coin discharge data is larger than ¥500 and an amount which is subtracted by ¥500 from the coin discharge data is used as a first renewal coin discharge data.

Next, it is determined that whether the first renewal coin discharge data is larger than ¥100 or not, and "1" is set as a discharge number of ¥100 only when the first renewal coin discharge data is larger than ¥100, and an amount which is subtracted ¥100 from the first renewal coin discharge data is used as a second renewal coin discharge data. And, again it is determined that whether the second renewal coin discharge data is still larger than ¥100 or not. Here, if the second renewal coin discharge data is still larger than ¥100, "2" is set as the discharge number of ¥100, and an amount which is further subtracted ¥100 from the second renewal coin discharge data is used as the second renewal coin discharge data. The above process is repeated until the second renewal coin discharge data becomes less than ¥100.

Next, it is determined that whether the second renewal coin discharge data is larger than ¥50 or not, and "1" is set as a discharge number of ¥50 only when the second renewal coin discharge data is larger than ¥50, and an amount which is subtracted by ¥50 from the second renewal coin discharge data is used as a third renewal coin discharge data.

Next, it is determined that whether the third renewal coin discharge data is larger than ¥10 or not, and "1" is set as a discharge number of ¥10 only when the third renewal coin discharge data is larger than ¥10, and an amount which is subtracted ¥10 from the third renewal coin discharge data is used as a fourth renewal coin discharge data. And, again it is determined that whether the fourth renewal coin discharge data is still larger than ¥10 or not. Here, if the fourth renewal coin discharge data is still larger than ¥10, "2" is set as the discharge number of ¥10, and an amount which is further subtracted by ¥10 from the fourth renewal coin discharge data is used as the fourth renewal coin discharge data. The above process is repeated until the fourth renewal coin discharge data becomes less than ¥10.

Next, it is determined that whether the fourth renewal coin discharge data is larger than ¥5 or not, and "1" is set as a discharge number of ¥5 only when the fourth renewal coin discharge data is larger than ¥5, and an amount which is subtracted ¥5 from the fourth renewal coin discharge data is used as a fifth renewal coin discharge data.

Lastly, it is determined that the remaining fifth renewal coin discharge data is a discharge number of ¥1 coin, and this process for determining the total number of coins to be discharged is completed.

CPU 100 sets the discharge number of coins for each denomination determined as described above, in the corresponding area 110*d* for setting discharge number of coin in the denomination table 110*a*. And, initialize the counters for discharged coin in the denomination table 110*a* to "0" for all denominations.

Furthermore, when the coin-discharging flag is set in the area 110*b* for setting coin-discharging flag, the motor 118 for inserting/discharging coins is turned ON by the motor driving circuit 124 for the motor 118 for inserting/discharging coins. And, the plunger/solenoid assembly 66 for the coin discharge shutter 64 of the coin-storing means 32, in which coins to be discharged more than one are stored, is turned ON by the solenoid-driving circuit 132 corresponding thereto. In addition, the motor 126 for selecting overflowed-coins is turned OFF, and the coin discharged from the coin-storing means 32 is guided to the coin discharge opening 20*e* by the discharged coin-guiding shute 80.

Since all of the plurality of cam rollers 62 of the plural coin-storing means 32 are driven at once and the coin discharge shutter 64 corresponding to the coin-storing means 32 in which coins to be discharged more than one are stored is opened, coins C are discharged one by one from the coin discharge opening 33 of the coin-storing means 32 the coin discharge shutter 64 of which is opened, by the friction force of the friction-increasing member 62*c* on the outer peripheral surface of the cam roller 62, and are guided to the coin discharge opening 20*e* by the discharged coin-guiding chute 80.

At this time, CPU 100 monitors the input of the discharged coin sensing signal from respective discharged-coin sensors 67 through the sensor-signal input circuit 134 for the discharged-coin sensors 67 at ST 2. And, whenever the discharged coin sensing signal is input from any one of the discharged-coin sensor 67, at ST 3 the discharged coin counter for the denomination corresponding to the discharged coin sensor 67 which outputs the discharged coin sensing signal is increased by "+1", and the stored coin counter of the same denomination is decrease by "−1".

Then, at ST 4 the value of the discharged-coin counter of the denomination corresponding to the discharged-coin sensor 67 which outputs the discharged coin sensing signal is compared with the value of the area for setting discharge number of coin of the same denomination in the denomination table 110*a*. If their values coincide with each other, at ST5 the plunger/solenoid assembly 66 for the coin-storing means 32 in which coins of the corresponding denomination are stored is turned OFF. Therefor, the corresponding coin discharge shutter 64 returns to the closed position, and discharge of coins from the coin-storing means 32 in which coins of the corresponding denomination are stored is stopped.

The process from ST 2 to ST 5 is repeated until the value of the discharged coin counter for each of all denominations of coins to be discharged coincide with the value of the corresponding area for setting discharge number of coin. And, when the value of the discharged coin counter of each of all denominations of coins to be discharged coincide with the value of the corresponding area for setting discharge number of coin, it is determined that the discharge has been completed. Thereafter, the motor 118 for inserting/discharging coins is turned OFF and the area for setting coin-discharging flag is reset to remove the coin-discharging flag, so that the rotation of the cam roller 62 for discharging coins is stopped.

Furthermore, the drawer driving mechanism 27 is turned ON through the drawer driving circuit 128 to complete the coin discharge process. And, the bank note-storing drawer 58 is moved to the open position.

[Coin Storage Process: see FIG. 17]

At ST 11, CPU 100 examines the area 110*b* for setting coin-discharging flag at every time when the interrupt signal X generated, for example, at intervals of 100 ms is input from the timer controller 101. And, when the coin-discharging flag is not set in the area 110*b* for setting coin-discharging flag, it is determined that coins are not discharged. At this time, it is examined at ST 12 that whether the coin-receiving signal from the received coin sensor 41 is input to the sensor-signal input circuit 140 or not.

When the coin-receiving signal is input to the sensor-signal input circuit 140, the timer counter 110*d* (see FIG. 15) is initialized to "0", and at ST 13 it is determined that whether the coin-storing flag is set in the area 110*c* for setting coin-storing flag (see FIG. 15) or not. Here, when the coin-storing flag is not set, it is determined that any cam rollers 62 are not being used to insert the received coins to their corresponding coin storing means S32. At this time, at ST 14 the coin-storing flag is set in the area 110*c* for setting coin-storing flag to show that the cam rollers 62 are used to insert the received coins to their corresponding coin storing means 32, and the motor 116 for receiving coins, the motor 54 for transporting coins, and the motor 118 for inserting/discharging coins are turned ON in the above described order through the motor driving circuits 120, 122 and 124. Thus, the coin storage process is completed.

In this process, at first the slanting transportation belt 38 located below the coin-receiving opening 20*a* (see FIG. 4) is driven by the separation roller 42, and then the horizontal transportation belt 52 is driven. Next, the cam rollers 62 are driven to insert the coins received by the coin-receiving opening 20*a* in the coin-storing means 32 corresponding to the denominations thereof.

When the coin-storing flag is set in the area 110*c* for setting coin-storing flag at ST 13, the motor 116 for receiving coins, the motor 54 for transporting coins, and the motor 118 for inserting/discharging coins have been already turned ON and the coins received by the coin-receiving opening 20*a* (see FIG. 4) are being stored. Thus, the coin storing process in this case is completed without performing the step of ST 14.

When the coins received by the coin-receiving opening 20*a* (see FIG. 4) are not sensed at ST 12, the area 110*c* for setting coin-storing flag (see FIG. 15) is examined at ST 15. Here, if the coin-storing flag is not set in the coin-storing flag setting area 110*c*, any coins are not received in the coin-receiving opening 20*a* (see. FIG. 4), and coins are not being in stored. Thus, this coin storing process is completed.

When the coin-storing flag is set in the area 110*c* for setting coin-storing flag (see FIG. 15) at ST 15, coins received in the coin-receiving opening 20*a* (see FIG. 4) are being stored. At this time, the timer counter 110*d* (see FIG. 15) is increased by "+1". Next, at ST 16, it is determined that whether the value of the timer counter 110*d* exceeds a predetermined value (value of the timer counter corresponding to sufficiently longer time than the time required for transporting a coin received in the coin-receiving opening 20*a* and storing it in the corresponding coin-storing means 32) or not.

Here, if the value of the timer counter 110*d* (see FIG. 15) does not reach at the predetermined value, at ST 18 it is determined that whether the assorted coin-sensing signals from the respective assorted coin sensors 67 are input to the sensor-signal input circuit 136 or not. And, when any of the assorted coin-sensing signals is input to the sensor-signal input circuit 136, at ST 19 "+1" is added in the stored coin counter in the denomination table 110*a* corresponding to the guide means 60 the assorted coin sensor 60*c* of which generated the assorted coin-sensing signal. And, at ST 20, the timer counter 110*d* is initialized to "0", and thus this coin storage process is completed.

On the other hand, at ST 18, when any of the assorted coin-sensing signals is not input from the assorted coin sensors 67 to the sensor-signal input circuit 136, this coin storage process is completed without performing the steps of ST 19 and ST 20.

Furthermore, when the value of the timer counter 110*d* (see FIG. 15) exceeds the above described predetermined value at ST 17, it is determined that all the coins received in the coin-receiving opening 20*a* have been stored in their corresponding coin-storing means 32 and any coin is not present in the coin-receiving opening 20*a* and on the coin-receiving plate 44. At this time, the coin-storing flag is removed from the area 110*c* for setting coin-storing flag (see FIG. 15) to show the non-storing state, and the motor 116 for receiving coins, the motor 54 for transporting coins, and the motor 118 for inserting/discharging coins are is turned OFF. Thus, this coin storage process is completed.

Furthermore, at ST 11, when the coin-discharging flag is set in the area 110*b* for setting coin-discharging flag (see FIG. 15), coins are being discharged. At this time, the area 110*c* for setting coin-storing flag (see FIG. 15) is examined at ST 21. When the coin-storing flag is set in the area 110*c* for setting coin-storing flag (see FIG. 15), the coin discharge process is started while the coin receiving process is stopped at once. That is, the coin discharge process has a priority to the coin storage process. Therefore, at ST 22, the coin-storing flag is removed from the area 110*c* for setting coin-storing flag (see FIG. 15) and the motor 116 for receiving coins and the motor 54 for transporting coins are turned OFF, and thus this storage process is completed.

At ST 21, when the coin-storing flag is removed from the area 110*c* for setting coin-storing flag (see FIG. 15), this coin storage process is completed without performing the step of ST 22.

[Overflow Process: see FIG. 18]

CPU 100 examines the area 110*b* for setting coin-discharging flag (see FIG. 15) and the area 110*c* for setting coin-storing flag (see FIG. 15) at every time when the interrupt signal Y generated, for example, at intervals of one minute from the timer controller 101. And, when the flag corresponding to either of the coin-discharging flag and the coin-storing flag 110*c* is set in the corresponding flag setting area 110*b* or 110*c*, it is determined that coins are being discharged or coins received in the coin-receiving opening 20*a* are being stored, and thus this overflow process is completed.

On the contrary, when both the coin-discharging flag and the coin-storing flag are set in their corresponding flag setting areas 110*b* and 110*c*, the value of the stored coin counter for each denomination is compared with the preliminarily set greatest number in the corresponding area 110*e* for setting the greatest number of coins storable to determine that whether the stored coins of each denomination overflowed or not. And when the value of the each stored coin counter for each denomination does not exceed the preliminary set greatest number for each denomination, it is determined that there is no overflow and thus this overflow process is completed.

On the contrary, when the value of the stored coin counter of at least one denomination exceeds the preliminary set greatest number for the corresponding denomination, it is determined that there is overflow. At this time, the motor 126 for selecting overflowed coins and the motor 118 for inserting/discharging coins are turned ON through the motor-driving circuits 130, 124, respectively. Furthermore, the plunger/solenoid assembly 66 for the coin discharge shutter 64 (see FIG. 7) of the coin-storing means 32 in which coins of the denomination exceeding the greatest number are stored is selected, and the selected plunger/solenoid assembly 66 is turned ON through the solenoid driving circuit 132 corresponding thereto.

Thereby, the coin-selecting gate member 84 is moved to the overflow position where the coins discharged from the coin-storing means 32 are guided to the overflow container 82. Further, the cam rollers 62 are rotated in the predetermined direction, and the discharge shutter 64 (see FIG. 7) of the coin-storing means 32 in which coins of the denomination exceeding the greatest number are stored is moved to the open position to allow the coins to be discharged one by one from the overflown coin line 34 of the coin-storing means 32 and the discharged coins are stored in the overflow container 55.

Next, at ST 31, it is monitored that whether the discharge-sensing signal from each of the coin discharge sensors 67 of the plural coin-storing means 32 is input to the corresponding sensor-signal input circuit 134 or not. And, at every time when the discharge-sensing signal is input from any one of the coin discharge sensors 67, at ST 32 "−1" is added to the stored coin counter for the denomination of coins stored in the coin-storing means 32 corresponding to the coin discharge sensor 67 which generates the discharge-sensing signal.

Here, at ST 33, the value of the stored coin counter which have been decreased as described above is compared with the greatest number preliminary set thereto. And, when the value of the stored coin counter becomes less than the greatest number preliminary set thereto, at ST 34, the plunger/solenoid assembly 66 for the coin discharge shutter 64 (see FIG. 7) of the coin-storing means 32 from which coins are discharged is turned OFF. Thus, the corresponding coin discharge shutter 64 returns to the closed position and the discharge of coins from the corresponding coin-storing means 32 is stopped.

The steps of the ST 31–ST 34 are repeated until the value of the stored coin counter for the overflowed denomination becomes smaller than the greatest number preliminary set thereto, and when it becomes small than the greatest number, it is determined that there is no overflow. At this time, the motor 118 for inserting/discharging coins is turned OFF, and the motor 126 for selecting overflowed coins is turned OFF, and thus this overflow process is completed.

According to this, the rotation of the cam rollers 62 is stopped, and the coin-selecting gate member 84 is returned to the usual position where coins discharged from the coin-storing means 32 are guided to the discharged coin guiding chute 80.

[Full Storing Alarming Process: see FIG. 19]

CPU 100 examines that whether any full storing signal from the full storing sensor 86 (see FIG. 6) of the plurality of coin-storing means 32 of the coin-storing cassette 30 is input to the sensor-signal input circuit 138 or not. And if a full storing signal is input from the full storing sensor 86 to the sensor-signal input circuit 138, it means that the overflow process has not been initiated due to some reasons, and the length of any one of coin line 34 among plural coin lines 34 stored in the plural coin-storing means 32 for plural denominations is longer by a predetermined distance than the length of coin lines 34 formed by coins of the greatest number at which the overflow process is initiated.

Therefore, when the full storing signal is input from the full storing sensor 86 to the sensor-signal input circuit 138, the display **20*d* at the central portion on the upper surface of the front cover 20 is used as a full storing alarming means, and an error code showing the full coin storing error is displayed on the display 20*d* through the display control circuit 114**.

Next, the area **110*c* for setting coin-storing flag (see FIG. 15) is examined. And, when the coin-storing flag is set in the area 110*c* for setting coin-storing flag, it is determined that the coins received in the coin-receiving opening 20*a* (see FIG. 1) are being stored in the plural coin-storing means 32 of the coin-storing cassette 30. At this time, at ST 41, the coin-storing flag is removed from the area 110*c* for setting coin-storing flag, and all of the motor 116 for receiving coins, the motor 54 for transporting coins, and the motor 118** for inserting/discharging coins are turned OFF, and thus this full storing alarming process is completed. As a result of this, the storage process for the received coins is stopped.

When the coin-storing flag has been removed from the area **110*c*** for setting coin-storing flag, this full storing alarming process is completed without performing the step of ST 41.

[Modifications]

Figure 20:
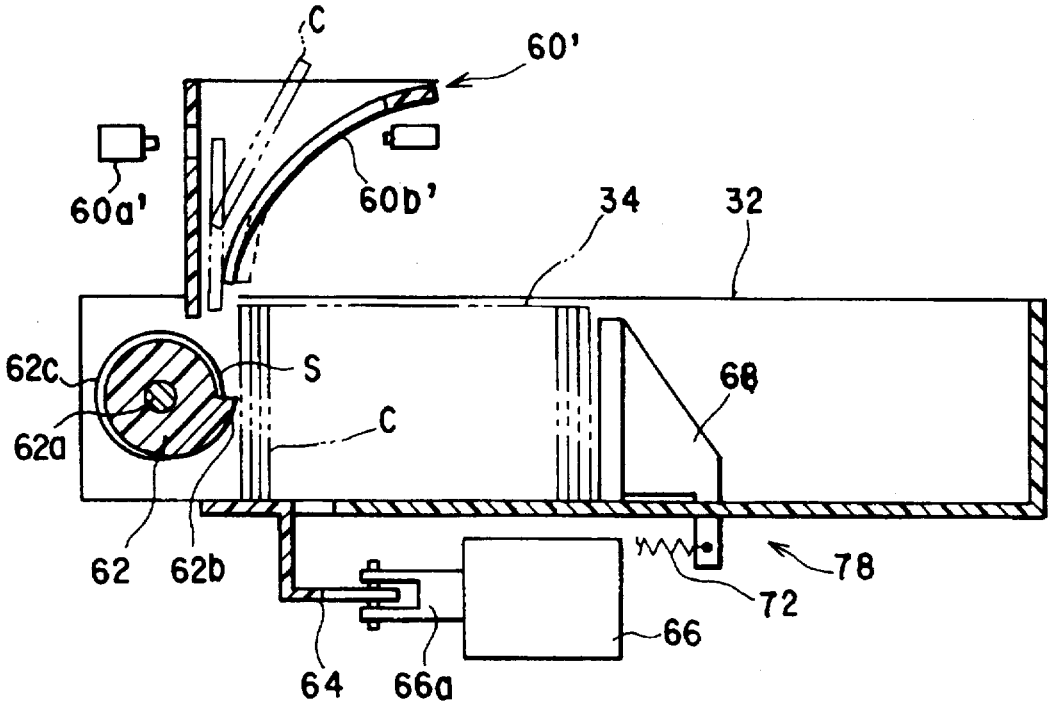
FIG. 20 is a longitudinally sectional view similar to FIGS. 12A and 12B, showing a modification of guide means for guiding coins from the coin transporting means to front end portions of the coin-storing means in one embodiment of the automatic coin discharge apparatus of the present invention.

In one embodiment of the automatic coin discharge apparatus of this invention which has been described with reference to FIGS. 1 to 19, the guide means 60 interposed between each of the coin-assorting holes 46 of the coin transportation means 28 and each of the front end portions of the coin-storing means 32 has the front wall **60*a* which is curved and the rear wall 60*b* which extends vertically and is elastically deformable. On the contrary to this, as shown in FIG. 20, the front wall 60*a*' may extends vertically and the rear wall 60*b*' may be curved with changing its extending gradually from in the substantially horizontal direction to in the substantially vertical direction as it proceeding forwardly. Further, the curved rear wall 60*b*' may be made elastically deformable. The guide means 60' of the modification having such a structure functions similarly as the guide means 60** of the above described one embodiment.

And according to conditions, even if each of the vertical and straight rear wall **60*b* of the guide means 60 in the above described one embodiment and the curved rear wall 60*b*' of the guide means 60' in the modification is not elastically deformable, it is always surely possible to insert the coin into the front end of coin line 34 of the coin-storing means 32 by the cam roller 62** as the coin inserting means.

Figure 21:
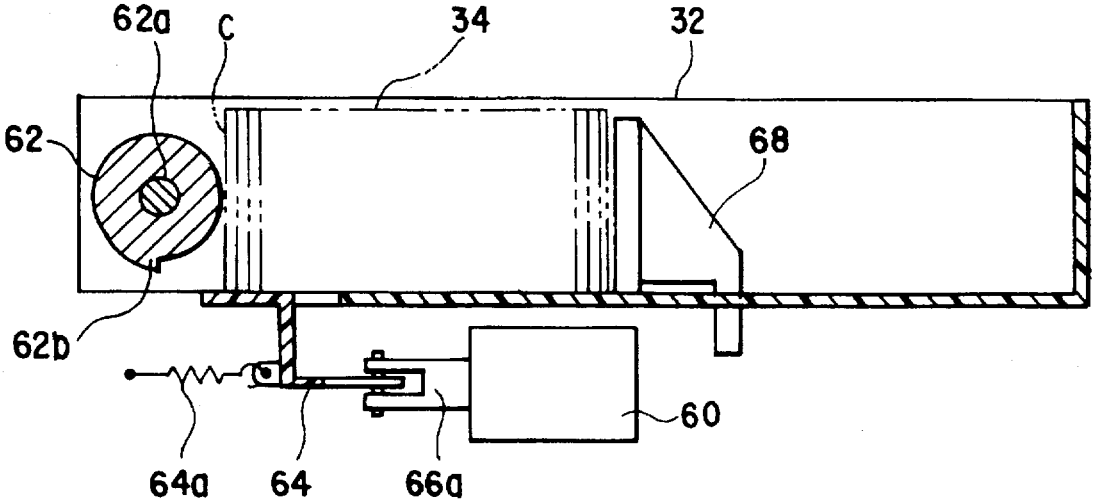
FIG. 21 is a longitudinally sectional view similar to FIGS. 12A and 12B, showing a modification of a cam roller of the coin inserting means in one embodiment of the automatic coin discharge apparatus of the present invention.

In the one embodiment of the automatic coin discharge apparatus of this invention which has been described with reference to FIGS. 1 to 19, the friction-increasing member **62*c* is attached on the outer peripheral surface of the cam roller 62. The cam roller 62 may, however, have no friction-increasing member 62*c* may be also used as shown in FIG. 21, by forming the cam roller 62** with a material having high friction coefficient with respect to coins C or by forming a pattern which generates high friction force with respect to coins C on its outer peripheral surface.

Figure 22:
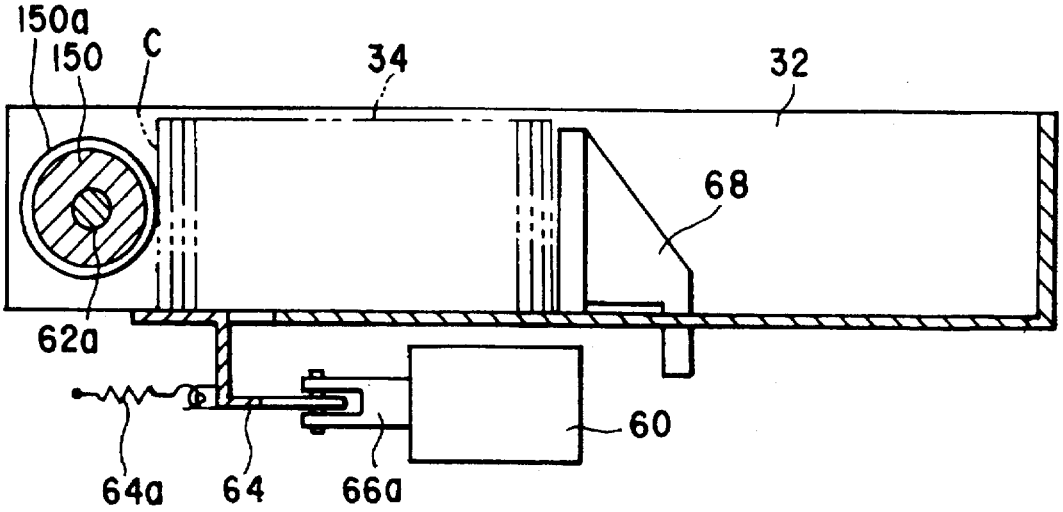
FIG. 22 is a longitudinally sectional view similar to FIGS. 12A and 12B, showing another modification of the coin inserting means in place of the cam roller of the coin inserting means in one embodiment of the automatic coin discharge apparatus of the present invention.

Furthermore, instead of the cam roller 62, as shown in FIG. 22, a roller 150 on the outer peripheral surface of which a friction-increasing member **150*a* is attached may be used. In this case, since the roller 150 does not function as the coin inserting space-producing means, it requires larger rotational driving force than that needed for the cam roller 62, in order to insert the coin C supplied from the horizontal transportation means 28 to the roller 150 via the guide means 60, into the front end of the corresponding coin-storing means 32. And, even in this case, the friction-increasing member 150*a* may be attached on the outer peripheral surface thereof only at the central portion in the widthwise direction of the roller 150. Further, the roller 150 may have no friction-increasing member 150*a* by forming the roller 150 of a material having high friction coefficient with respect to coins C or by forming a pattern which generates high friction force with respect to coins C on the outer peripheral surface of the roller 150**.

Figure 23:
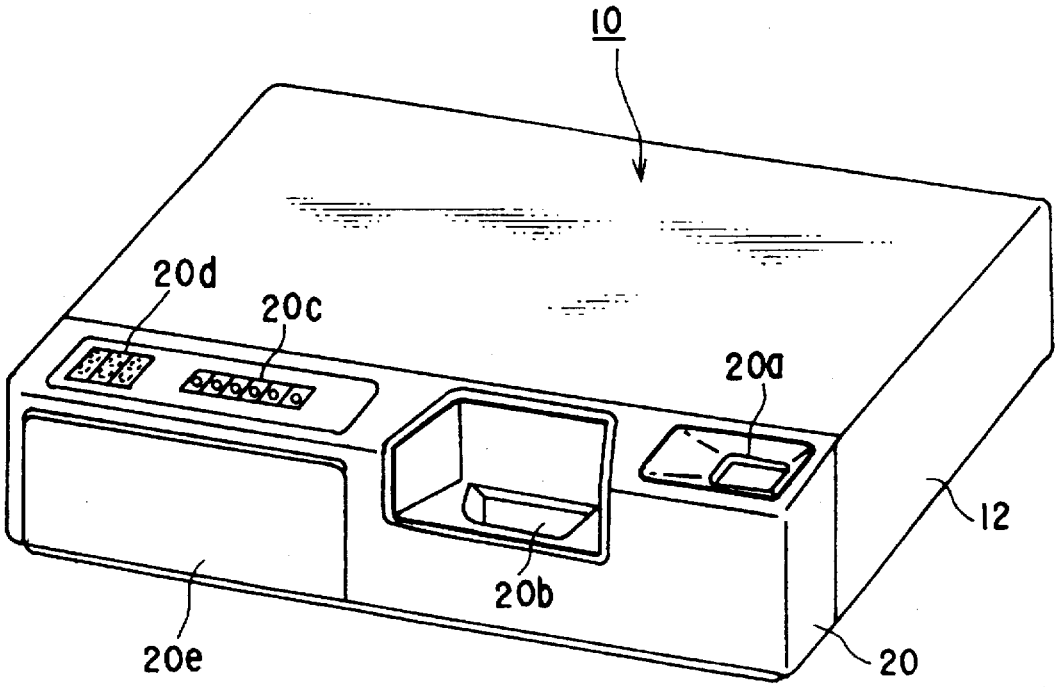
FIG. 23 is a perspective view similar to FIG. 1, showing a modification of a locational relationship between a bank note-storing drawer, a coin receiving opening and a coin discharge opening in a front cover of the one embodiment of the automatic coin discharge apparatus of the present invention.

Furthermore, it may be that, as shown in FIG. 23, the bank note-storing drawer **20*e* is arranged at the left end portion of the front cover 20 and is housed below the plural coin-storing means 32 of the coin-storing cassette 30 in the housing body 12, the coin-receiving opening 20*a* and the coin discharge opening 20*b* are arranged on the right side of the bank note-storing drawer 20*e* on the upper surface of the front cover 20, and the coin-receiving opening 20*a* is arranged on the right side of the coin discharge opening 20*b***.

Furthermore, the overflow container 82 and the coin-selecting gate member 84 may be omitted from this invention. When they are omitted, coins discharged from plural coin-storing means 32 of the coin-storing cassette 30 by the overflow process are discharged to the coin discharge opening **20*b*. Coins discharged to the coin discharge opening 20*b*** by the overflow process are collected by the operator of the automatic coin discharge apparatus of this invention, every time the overflow process is executed.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An automatic coin discharge apparatus comprising:

a housing having a coin-receiving opening and a coin discharge opening;

coin-storing means extending in a substantially horizontal direction in the housing and storing a plurality of coins of the same denomination in a piled-up state in one line in the substantially horizontal direction, in the piled-up coins each of the coins being in a standing state and side surfaces of the coins facing each other;

coin-urging means for urging the plurality of coins in the coin line in the coin-storing means toward one end portion of the coin-storing means in a direction along the coin line;

coin transporting means extending in the housing from the coin-receiving opening toward one end portion of the coin-storing means, and transporting coins received by the coin-receiving opening toward the one end portion of the coin-storing means with the coin being transported in a horizontally laid down state;

coin inserting means for inserting coins transported toward the one end portion of the coin-storing means by the coin transporting means, into a position nearest to the one end portion of the coin-storing means in the coin line in the coin-storing means with the coin being inserted in the standing state; and guide means for guiding the coin from the coin transporting means to the coin inserting means by using gravity and changing the coin from in the horizontally laid down state to in the standing state while the coin is guided by gravity; and coin discharge means for selectively discharging the coin in the position nearest to the one end portion of the coin-storing means in the coin line in the coin-storing means, from the coin-storing means toward the coin discharge opening of the housing with the coin being discharged in the standing state.

2. An automatic coin discharge apparatus according to claim 1, further comprising:

a plurality of coin-storing means, a plurality of coin guide means, a plurality of coin inserting means, and a plurality of coin discharge means; and wherein:

the plurality of coin-storing means are arranged along the transporting direction of coins in the coin transporting means and extend in the same direction as to each other, and the denominations of coins stored in the plural coin-storing means are different from each other;

the guide means, the coin inserting means and the coin discharge means are provided at one end portion of each of the plurality of coin-storing means on the side of the coin transporting means; and gate means for assorting the coins of various denominations to supply them respectively through the coin guide means to the coin inserting means of the one end portions of the coin-storing means corresponding to the various denominations, are provided in positions of the coin transporting means corresponding to the one end portions of the plurality of coin-storing means.

3. An automatic coin discharge apparatus according to claim 1, wherein the housing has a front end portion facing an operator of the automatic coin discharge apparatus, the coin-receiving opening and the coin discharge opening are provided at the front end portion of the housing, the coin-storing means extends from the front end portion of the housing toward a rear end portion of the housing, the coin transporting means extends substantially horizontally along the front end portion of the housing in a direction to cross the extending direction of the coin-storing means and transports coins in the horizontally laid down state, and the guide means, the coin inserting means and the coin discharge means are provided at the front end portion of the coin-storing means.

4. An automatic coin discharge apparatus according to claim 3, further comprising:

a plurality of coin-storing means, a plurality of coin guide means, a plurality of coin inserting means, and a plurality of coin discharge means, and wherein:

the plurality of coin-storing means are arranged along the transporting direction of coins in the coin transporting means and extend in the same direction as to each other, and denominations of coins stored in the plural coin-storing means are different from each other, the guide means, the coin inserting means and the coin discharge means are provided at the front end portion of each of the plurality of coin-storing means, and gate means for assorting the coins of various denominations to supply them respectively through the coin guide means to the coin inserting means of the front end portion of the coin-storing means corresponding to the various denominations, are provided in positions of the transporting means corresponding to the front end portions of the plurality of coin-storing means in the coin transportation means.

5. An automatic coin discharge apparatus according to claim 1, wherein the coin-urging means further includes a movable pushing member which is provided to be movable in a direction along the coin line of the coin-storing means and abuts against a coin located at the other end in the coin line on the opposite side to the one end portion of the coin-storing means, and a flexible elongate urging means which is extended from the movable pushing member toward the one end portion of the coin-storing means, thereafter changing its extending direction toward the other end portion of the coin-storing means on the opposite side to the one end portion of the coin-storing means, and a portion of the elongate urging means between the movable pushing member and the extending direction-changing position generates the urging force toward the one end portion of the coin-storing means, and the remaining portion of the elongate urging means between the extending direction-changing position and the other end portion of the coin-storing means generates an urging force toward the other end portion of the coin-storing means.

6. An automatic coin discharge apparatus according to claim 1, wherein the coin inserting means further has a roller coming in contact with a side surface of the coin at the position nearest to the one end portion of the coin-storing means in the coin line within the coin-storing means, the coin transporting means is located above the one end portion of the coin-storing means, and the guide means is provided between the coin transporting means and the roller of the coin inserting means.

7. An automatic coin discharge apparatus according to claim 6, wherein the peripheral surface of the roller of the coin inserting means is further provided with a friction-increasing member.

8. An automatic coin discharge apparatus according to claim 7, wherein the width of the friction-increasing member on the peripheral surface of the roller of the coin inserting means is narrower than that of the side surface of the coin, and the friction-increasing member is arranged to only contact the central portion of the side surface of the coin in its widthwise direction.

9. An automatic coin discharge apparatus according to claim 6, wherein the coin discharge means further includes a roller common to that of the coin inserting means, and a coin discharge shutter provided at the one end portion of the coin-storing means to be operated selectively, and the coin discharge shutter forms an opening corresponding to the lower half of the peripheral edge of the coin at the position nearest to the one end portion of the coin-storing means in the coin line within the coin-storing means, in the opening position.

10. An automatic coin discharge apparatus according to claim 1, wherein the coin inserting means further includes coin inserting space-producing means for pushing back the coin line in the coin-storing means toward the other end portion of the coin-storing means opposite to the one end portion thereof, against the urging force of the coin-urging means to produce a space for inserting a coin from the coin transporting means to the position nearest to the one end portion of the coin-storing means in the coin line within the coin-storing means;

the coin transporting means is located above the one end portion of the coin-storing means; and the coin guide means guides a coin from the coin transporting means to the coin inserting space-producing means such that the coin reaches at the coin inserting space-producing means in a standing state, and is provided between the coin transporting means and the coin inserting space-producing means of the coin inserting means.

11. An automatic coin discharge apparatus according to claim 10, wherein the coin inserting space-producing means of the coin inserting means further has a cam roller which contacts the side surface of the coin at the position nearest to the one end portion of the coin-storing means in the coin line within the coin-storing means, and the cam roller has at least one cam projection on a peripheral surface thereof.

12. An automatic coin discharge apparatus according to claim 11, wherein the coin discharge means further includes a cam roller common to that of the coin inserting means, and a coin discharge shutter provided at the one end portion of the coin-storing means to be opened selectively, and the coin discharge shutter forms an opening corresponding to the lower half of the peripheral edge of the coin at the position nearest to the one end portion of the coin-storing means in the coin line within the coin-storing means, in the opening position.

13. An automatic coin discharge apparatus according to claim 12, wherein the peripheral surface of the cam roller of the coin inserting means, excluding the cam projection, provided with a friction-increasing member extending in the peripheral direction.

14. An automatic coin discharge apparatus according to claim 13, wherein the width of the friction-increasing member is narrower than that of the side surface of the coin, and the friction-increasing member only contacts the central portion of the side surface of the coin in its widthwise direction.

15. An automatic coin discharge apparatus according to claim 1, wherein the coin transporting means is located above the one end portion of the coin-storing means and transports the coin in a horizontal state, and the coin guide means for guiding the coin from the coin transporting means to the coin inserting means is provided between the coin transporting means and the coin inserting means, the coin guide means changes the posture of the coin from the horizontal state to the standing state while the coin is guided from the transporting means to the inserting means.

16. An automatic coin discharge apparatus according to claim 15, wherein the coin guide means further includes kinetic energy-reducing means for absorbing the kinetic energy of the coin while it is changed from the horizontal state to the standing state and for reducing the kinetic energy of the coin when the coin arrives at the coin inserting means.

17. An automatic coin discharge apparatus according to claim 16, wherein the kinetic energy-reducing means further includes an elastically deformable member which is mounted to be collided with the coin while the coin is being changed from the horizontal state to the standing state so that the deformable member is elastically deformed to reduce the kinetic energy of the coin.

18. An automatic coin discharge apparatus according to claim 10, wherein the coin guide means guides the coins from the coin transporting means to the coin inserting means and at the same time changes the posture of the coin from the horizontal state to the standing state, and the coin guide means further includes kinetic energy-reducing means for absorbing the kinetic energy of the coin while it is changed from the horizontal state to the standing state and for reducing the kinetic energy of the coin when the coin arrives at the coin inserting means.

19. An automatic coin discharge apparatus according to claim 18, wherein the kinetic energy-reducing means further includes an elastically deformable member which is mounted to be collided with the coin while being changed from the horizontal state to the standing state so that the deformable member is elastically deformed to reduce the kinetic energy of the coin.

20. An automatic coin discharge apparatus according to claim 1, further comprising:

stored-coin number counting means for counting the number of coins currently stored in the coin-storing means by counting up every time when a coin is stored in the coin-storing means by the coin inserting means, and by counting down every time when a coin is discharged from the coin-storing means by the coin discharge means; and overflow means for discharging a predetermined number of coins from the coin-storing means by the coin discharge means when the current number of stored coins counted by the stored-coin number counting means reaches a preliminarily set greatest number.

21. An automatic coin discharge apparatus according to claim 20, further comprising:

full-coins sensing means for generating a full-coins sensing signal when the length of the coin line formed by a plurality of coins stored in the coin-storing means becomes longer by a predetermined distance than the length of the coin line formed by coins of the greatest number at the time of operation of the overflow means; and full-coins alarming means for giving a full-coins alarm when it receives the full-coins sensing signal from the full-coins sensing means.

22. An automatic coin discharge apparatus according to claim 20, further comprising:

an overflow container provided in the housing; and discharged-coin guiding means provided in the housing for guiding coins from the coin discharge means to the coin discharge opening of the housing;

wherein the discharged-coin guiding means further includes overflowed coin-selecting means which is operated when the overflow means is activated, and guides the coins discharged from the coin-storing means by the coin discharge means to the overflow container.

23. An automatic coin discharge apparatus according to claim 22, further comprising:

full-coin sensing means for generating a full-coins sensing signal when the length of the coin line formed by a plurality of coins stored in the coin-storing means becomes longer by a predetermined distance than the length of the coin line formed by coins of the greatest number at the time of operation of the overflow means; and full-coins alarming means forgiving a full-coins alarm when it receives the full-coins sensing signal from the full-coins sensing means.

24. An automatic coin discharge apparatus according to claim 3, wherein:

the housing further comprises a bank note-storing drawer, the bank note-storing drawer is arranged between the coin-receiving opening and the coin discharge opening, the coin-receiving opening is located on the right side of the drawer, and the coin discharge opening is located on the left side of the drawer.

25. An automatic coin discharge apparatus according to claim 3, wherein:

the housing further comprises a bank note-storing drawer, both of the coin-receiving opening and the coin discharge opening are arranged on the right side of the bank note-storing drawer, and the coin-receiving opening is arranged on the right side of the coin discharge opening.

* * * * *